US007171146B2

(12) United States Patent
Sato et al.

(10) Patent No.: US 7,171,146 B2
(45) Date of Patent: Jan. 30, 2007

(54) IMAGE FORMING APPARATUS INCLUDING A BELT-SHAPED IMAGE CARRIER

(75) Inventors: Noribumi Sato, Saitama (JP); Tomoya Saeki, Saitama (JP); Nobuhiro Hiroe, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 214 days.

(21) Appl. No.: 10/929,454

(22) Filed: Aug. 31, 2004

(65) Prior Publication Data

US 2005/0158086 A1 Jul. 21, 2005

(30) Foreign Application Priority Data

Dec. 26, 2003 (JP) ..... P. 2003-435684

(51) Int. Cl.
*G03G 15/01* (2006.01)

(52) U.S. Cl. ..... 399/301; 399/302; 399/303

(58) Field of Classification Search ..... 399/297, 399/298, 299, 301, 302, 308, 49, 72
See application file for complete search history.

(56) References Cited

U.S. PATENT DOCUMENTS 5,995,802 A * 11/1999 Mori et al. ..... 399/394
6,219,517 B1 * 4/2001 Takahashi et al. ..... 399/301
6,674,988 B2 * 1/2004 Kawanishi ..... 399/301

FOREIGN PATENT DOCUMENTS

| | | |
|---|---|---|
| JP | 2962088 B | 8/1999 |
| JP | 2001-134040 | 5/2001 |
| JP | 2003-195712 | 7/2003 |
| JP | 2003-215877 | 7/2003 |

* cited by examiner

*Primary Examiner*—Hoan Tran
(74) *Attorney, Agent, or Firm*—Morgan Lewis & Bockius LLP

(57) ABSTRACT

An image forming apparatus which includes an image carrier holding toner images of plural colors, and a transfer portion that transfers the toner images of plural of colors held on the image carrier onto a recording medium, wherein the image carrier is made of an elastic material, has a pattern image forming unit repeatedly forming a pattern image for color misregistration detection on the image carrier at a constant interval so as to set the pattern images within a length range of the recording medium, wherein one of the pattern images includes a first toner image group in which plural toner images of a first color is formed at a first interval, and a second toner image group in which plural toner images of a second color is formed at a second interval.

11 Claims, 19 Drawing Sheets

IMAGE FORMING APPARATUS INCLUDING A BELT-SHAPED IMAGE CARRIER

BACKGROUND OF THE INVENTION

1. Field of the Invention

The present invention relates to an image forming apparatus such as a copying machine or a printer using electrophotography, and particularly relates to an image forming apparatus capable of forming a full color image using a belt-like intermediate transferor.

2. Description of the Related Art

JP-B-2,962,088, JP-A-2001-134040, JP-A-2003-195712 and JP-A-2003-215877 are referred to as related arts.

In the background art, various systems have been proposed and manufactured as this kind of image forming apparatus such as copying machines or printers using electrophotography. Of the image forming apparatus, particularly color image forming apparatus for forming a full color image can be roughly classified into a type using an intermediate transferor and a type not using an intermediate transferor. In the image forming apparatus using an intermediate transferor, a toner image formed on a photoconductor is once primary-transferred onto the intermediate transferor, so that primary transfer can be performed independently of the material of a recording medium. Thus, the image forming apparatus using an intermediate transferor is advantageous to improvement in the quality of the full color image.

The color image forming apparatus using an intermediate transferor is classified into a so-called "four-cycle system" and a so-called "tandem system". The "four-cycle system" color image forming apparatus is designed to form a color image as follows. That is, color toner images of yellow, magenta, cyan, black and the like formed in turn on a single photoconductor are primary-transferred onto an intermediate transferor so as to be superimposed on one another. After that, the toner images of yellow, magenta, cyan, black and the like multilayer-transferred onto the intermediate transferor are secondary-transferred onto a recording medium by a secondary transfer roll.

On the other hand, the "tandem system" color image forming apparatus is designed to form a color image as follows. That is, toner images of different colors from one another, such as yellow, magenta, cyan and black, formed respectively on plural (e.g. four) photoconductors are primary-transferred onto an intermediate transferor so as to be superimposed on one another. After that, the toner images of yellow, magenta, cyan, black and the like multilayer-transferred onto the intermediate transferor are secondary-transferred onto a recording medium by a secondary transfer roll.

In the color image forming apparatus using an intermediate transferor which apparatus is either the "four-cycle system" or the "tandem system", there may occur a fluctuation in the moving velocity or the like of the photoconductor(s) or the intermediate transferor when the toner images formed on the photoconductor(s) are primary-transferred onto the intermediate transferor or when the toner images primary-transferred onto the intermediate transferor are secondary-transferred onto the recording medium. In such a case, color misregistration occurs due to the fluctuation in the velocity or the like of the photoconductor(s) or the intermediate transferor. For example, the fluctuation in the velocity of the intermediate transferor is caused by a fluctuation in the load on the intermediate transferor due to the secondary transfer roll or a cleaning unit touching or leaving the intermediate transferor.

Therefore, related art that can prevent such color misregistration from occurring due to a fluctuation in the velocity or the like of a photoconductor or an intermediate transferor have been disclosed in JP-B-2,962,088, JP-A-2001-134040, JP-A-2003-195712, JP-A-2003-215877, etc.

A color printer according to JP-B-2,962,088 includes a photoconductor rotated by a photoconductor drive unit, an exposure unit for exposing the photoconductor to laser beams to thereby form a latent image, a development unit for developing the latent image formed on the photoconductor in different color by each rotation to thereby form toner images, an intermediate transferor to which the toner images of different colors formed on the photoconductor are transferred to be superimposed on one another, a transfer unit for transferring the images transferred onto the intermediate transferor further onto a recording medium, and a control unit for controlling the photoconductor drive unit to rotate the photoconductor at a desired rotation velocity. The intermediate transferor and the photoconductor are disposed in contact with each other so that the intermediate transferor is driven to rotate by the photoconductor. The color printer further includes a detection unit for detecting the intermediate transferor passing a specific position, and an intermediate transferor rotation velocity measuring unit for obtaining the rotation velocity of the intermediate transferor on the basis of the output of the detection unit. Based on the measured rotation velocity of the intermediate transferor, the desired rotation velocity of the photoconductor is changed before the latent image is formed on the photoconductor. Thus, the difference in rotation velocity among the rotations of the intermediate transferor is suppressed. The desired rotation velocity of the photoconductor is kept constant during the formation of the latent image on the photoconductor.

Image forming apparatus according to JP-A-2001-134040 includes a latent image carrier, an exposure unit for exposing the latent image carrier plural times correspondingly to respective images of color components of a color image, a development unit for developing latent images of the respective color components formed on the latent image carrier with toners respectively, an intermediate transferor marked with a reference position mark indicating a reference position for determining the exposure start timing of the exposure unit, a transfer unit for transferring toner images of the respective color components developed on the latent image carrier onto the intermediate transferor so as to register the end portions of the toner images with one another based on the reference position, a detection unit for detecting a detection period of the reference position mark, and a control unit for obtaining a difference between the detection period of the reference position mark and a predetermined specific detection period and making control to extend/shorten the exposure start timing of each identical color component at the time of forming the next color image by time corresponding to the obtained difference.

Image forming apparatus according to JP-A-2003-195712 includes an endless photoconductor to be moved circumferentially, an exposure unit for exposing the photoconductor in an exposure position of the photoconductor based on image information to thereby form a latent image on the photoconductor, a development unit for developing the latent image with a developer in a development position downward in the moving direction of the photoconductor with respect to the exposure position of the exposure unit so as to form an image using the developer, an endless image carrier to be moved circumferentially in contact with the photoconductor in a primary transfer position downstream in the moving direction of the photoconductor with respect to the development position of the photoconductor so that the image using the developer is transferred onto the image carrier in the primary transfer position, a secondary transfer unit for transferring the image using the developer onto a recording medium in a secondary transfer position downstream in the moving direction of the image carrier with respect to the primary transfer position of the image carrier, a cleaning unit provided to be able to touch and leave the image carrier in a cleaning position downstream in the moving direction of the image carrier with respect to the secondary transfer position of the image carrier and upstream with respect to the primary transfer position so as to remove the developer remaining on the image carrier after the secondary transfer by the secondary transfer unit due to the contact operation of the cleaning unit, and a control unit for controlling the cleaning unit to perform the contact operation and the separation operation in the cleaning position when the exposure unit does not engage in performing the latent image forming operation on the photoconductor.

Color printing apparatus according to JP-A-2003-215877 accepts an input of a correction value for correcting the misregistration of a printing position with respect to a color of reference. The color printing apparatus includes a correction guide printing unit. The correction guide printing unit prints a correction guide in which grids having different widths and different intervals are disposed and superimposed on each other for the color of reference as to the printing position and a color to be corrected as to the printing position. The correction guide shows the size of printing position misregistration of the color to be corrected with respect to the reference color on the basis of a distance of a predetermined pattern expressed by the color to be corrected from a predetermined reference position. The correction guide printing unit prints a scale in which a distance from the predetermined reference position is associated with a correction value to be inputted. The scale is designed so that the correction value at the time of printing the correction guide corresponds to the reference position.

However, the aforementioned related art have problems as follows. That is, each of the related art disclosed in JP-B-2,962,088, JP-A-2001-134040, JP-A-2003-195712, etc. is designed to change the rotation velocity of the photoconductor or the intermediate transferor, to make control to extend/shorten the exposure start timing in accordance with the difference between the detection period of the reference position mark and the predetermined specific detection period, or to perform the contact operation and the separation operation of the cleaning unit in the cleaning position when no latent image is being written onto the photoconductor. On the other hand, the related art disclosed in JP-A-2003-215877 is designed so that the correction guide printing unit prints the correction guide showing the size of the printing position misregistration of the color to be corrected with respect to the reference color, and a correction value for correcting the printing position misregistration obtained by the correction guide is accepted.

However, in such image forming apparatus, an operation of the cleaning unit or the secondary transfer roll touching/leaving the surface of the intermediate transferor may be inserted into the operation of forming or transferring toner images of respective colors such as yellow, magenta, cyan and black. In such a case, there is a problem that there may occur a fluctuation of velocity in the intermediate transferor, causing color misregistration.

In the case where the contact/separation of the cleaning unit is designed to be performed when no latent image is being written onto the photoconductor, there is a problem as follows. That is, the timing when termination of the operation of cleaning the intermediate transferor by the cleaning unit is so late that the productivity in forming images per unit time is lowered inevitably.

On the other hand, according to the related art disclosed in JP-A-2003-215877, misregistration of a printing position at the time of normal image formation can be obtained visually and corrected using the correction guide. However, the operation of the cleaning unit or the secondary transfer roll touching/leaving the surface of the intermediate transferor may be inserted into the image forming operation. In such a case, there is a problem that the occurrence of color misregistration in the process direction cannot be detected.

SUMMARY OF THE INVENTION

The present invention has been made in view of the above circumstances and provides an image forming apparatus in which the occurrence of color misregistration in the process direction can be detected visually even when the operation of a cleaning unit or a secondary transfer member touching/leaving the surface of an intermediate transferor is inserted into an image forming operation.

The invention provides an image forming apparatus according to the invention includes an image carrier, shaped like a belt, that holds toner images of plural colors, and a transfer portion that transfers the toner images of a plurality of colors held on the image carrier onto a recording medium, wherein the image carrier is made of an elastic material, having: a pattern image forming unit that repeatedly forms a pattern image for color misregistration detection on the image carrier at a constant interval so as to set the pattern images within a length range of the recording medium in the rotating direction of the image carrier, wherein one of the pattern images includes a first toner image group in which a plurality of toner images of a second color is formed at a second interval in the rotating direction of the image carrier. A so-called ladder chart may be used as each of the toner images. In the ladder chart, for example, plural line segments formed in a direction perpendicular to the rotating direction of the image carrier are disposed in the rotating direction of the image carrier.

Furthermore, the pattern image forming unit forms the pattern image in which the second interval is different from the first interval, and the second toner image group is closed to the first toner image group.

According to this configuration, since the toner image of the first color and the toner image of the second color are formed closely to each other, misregistration of the toner image of one color with respect to the toner image of another color can be confirmed visually easily. Thus, color misregistration in the rotating direction of the image carrier can be detected easily all over the length of the recording medium by a user.

When an elastic belt having elasticity in the rotating direction of the image carrier is used as the image carrier, the image carrier is apt to expand/contract in the rotating direction of the image carrier. Such color misregistration with different distances that can occur within the length range of the recording medium can be detected effectively. As a result, different correction operations can be applied correspondingly to misregistration with different distances.

According to the invention, it is possible to provide image forming apparatus in which the occurrence of color misregistration in the process direction can be detected visually even when the operation of a cleaning unit or a secondary transfer member touching/leaving the surface of an intermediate transferor is inserted into an image forming operation.

BRIEF DESCRIPTION OF THE DRAWINGS

Preferred embodiment of the present invention will be described in detail based on the following figures, wherein.

DETAILED DESCRIPTION OF THE PREFERRED EMBODIMENTS

Embodiments of the invention will be described below with reference to the drawings.

[First Embodiment]

Figure 2:
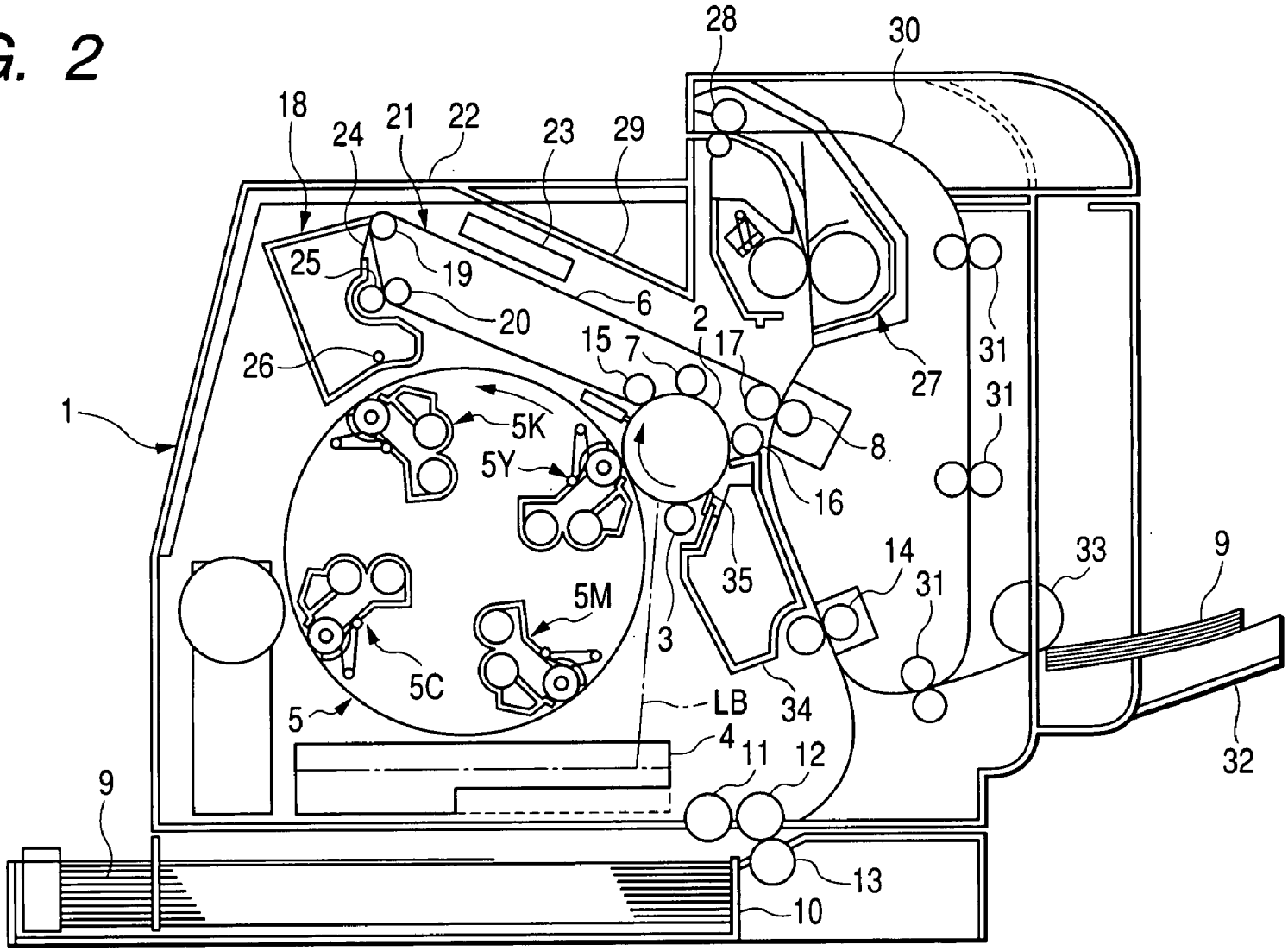
FIG. 2 is a configuration view of the full color printer as image forming apparatus according to the first embodiment of the invention.
Figure 3:
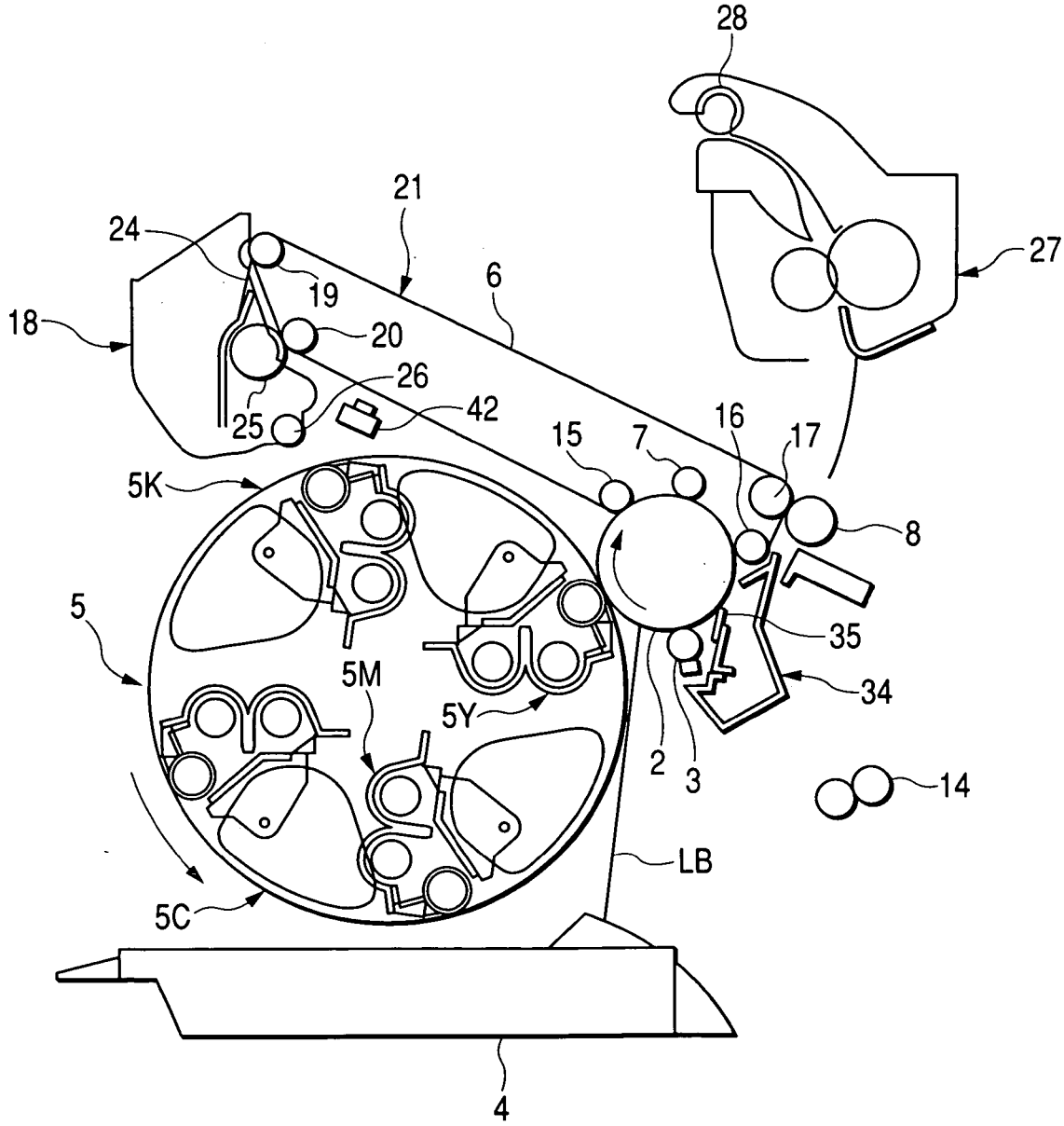
FIG. 3 is a configuration view showing a main portion of the full color printer as image forming apparatus according to the first embodiment of the invention.

FIG. 2 is an overall configuration view showing a four-cycle system full color printer as image forming apparatus according to a first embodiment of the invention. FIG. 3 is a configuration view showing an image forming portion of the four-cycle system full color printer as image forming apparatus according to the first embodiment of the invention.

In FIG. 2, the reference numeral 1 represents a body of the full color printer. Inside the full color printer body 1, a photoconductor drum 2 serving as an image carrier is rotatablly disposed a little to the right upper portion with respect to the center. The photoconductor drum 2 is, for example, configured from a conductive cylinder coated with a photoconductor layer made from OPC or the like, and having a diameter of about 47 mm. The photoconductor drum 2 is driven to rotate at a process speed of about 150 mm/sec in the arrow direction by a not-shown drive unit. As shown in FIG. 3, the surface of the photoconductor drum 2 is charged to predetermined potential by a charging roll 3 serving as a charging unit and disposed substantially just under the photoconductor drum 2. After that, the surface of the photoconductor 2 is exposed to laser beams (LB) in accordance with an image to be formed by an ROS (Raster Output Scanner) 4 serving as an exposure unit disposed just under the photoconductor drum 2 and at a distance therefrom. Thus, an electrostatic latent image is formed in accordance with image information. The electrostatic latent image formed on the photoconductor drum 2 is developed by a rotary development unit 5 having development devices 5Y, 5M, 5C and 5K of respective colors of yellow (Y), magenta (M), cyan (C) and black (K) disposed circumferentially. Thus, a toner image of a given color is obtained.

In that event, the steps of charging, exposure and development on the surface of the photoconductor drum 2 are repeated a given number of times in accordance with the color of the image to be formed. The rotary development unit 5 is driven to rotate at given timing so that one of the development devices 5Y, 5M, 5C and 5K corresponding to the color to be developed is moved to a development position opposed to the photoconductor drum 2. For example, when a full color image is formed, the steps of charging, exposure and development on the surface of the photoconductor drum 2 are repeated four times correspondingly to the respective colors of yellow (Y), magenta (M), cyan (C) and black (K) so that toner images corresponding to the colors of yellow (Y), magenta (M), cyan (C) and black (K) are formed in turn on the surface of the photoconductor drum 2. The number of rotations of the photoconductor drum 2 for forming the toner images differs in accordance with the image size. For example, when the image size is an A-4 size, a toner image of one color is formed by three rotations of the photoconductor drum 2. That is, a toner image corresponding to each color of yellow (Y), magenta (M), cyan (C) and black (K) is formed in turn on the surface of the photoconductor drum 2 by every three rotations of the photoconductor drum 2. As will be described later, the toner images formed in turn on the photoconductor drum 2 are primary-transferred onto the intermediate transfer belt 6 so as to be superimposed on one another when the photoconductor drum 2 passes the primary transfer position.

In the primary transfer position, the intermediate transfer belt 6 as an intermediate transferor also serving as a image carrier shaped like a belt according to the invention is wound on the outer circumference of the photoconductor drum 2. In the primary transfer position, the toner images of the respective colors of yellow (Y), magenta (M), cyan (C) and black (K) formed in turn on the photoconductor drum 2 are primary-transferred onto the intermediate transfer belt 6 by a primary transfer roll 7 as they remain superimposed on one another. The toner images of yellow (Y), magenta (M), cyan (C) and black (K) multilayer-transferred onto the intermediate transfer belt 6 are secondary-transferred in a lump onto recording paper 9 by a secondary transfer roll 8. The recording paper 9 serves as a recording medium to be fed at given timing. The secondary transfer roll 8 may be designed to be driven by the intermediate transfer belt 6. However, the secondary transfer roll 8 may be designed to be driven to rotate through gears by a not-shown driving source. In that case, it is desired that the secondary transfer roll 8 is designed to be driven to rotate through a torque limiter so that the secondary transfer roll 8 runs idle when the rotation velocity of the secondary transfer roll 8 is higher than that of the intermediate transfer belt 6. Thus, a difference in moving velocity is prevented from occurring between the secondary transfer roll 8 and the intermediate transfer belt 6. As shown in FIG. 2, sheets of the recording paper 9 handled by a feed roll 12 and a retard roll 13 are fed out one by one from a paper feed portion 10 by a pickup roll 11. The paper feed portion 10 is disposed under the full color printer body 1. The recording paper 9 is conveyed to the secondary transfer position of the intermediate transfer belt 6 by a registration roll 14 synchronously with the toner images transferred onto the intermediate transfer belt 6. The secondary transfer roll 8 is designed to touch and leave the surface of the intermediate transfer belt 6 at given timing.

As shown in FIG. 3, the intermediate transfer belt 6 is stretched by plural rolls, and designed to be driven with the rotation of the photoconductor drum 2 so as to move and circulate at a given process speed (about 150 mm/sec). The intermediate transfer belt 6 is made of an elastic belt having stretchability, such as chloroprene rubber, urea rubber or silicon rubber, so that the Young's modulus of an elastic layer thereof is not higher than 30 MPa. In addition, the intermediate transfer belt 6 is stretched in predetermined tension among a wrap-in roll 15 for specifying the wrap position of the intermediate transfer belt 6 on the upstream side of the photoconductor drum 2 in its rotating direction, the primary transfer roll 7 for transferring toner images formed on the photoconductor drum 2 onto the intermediate transfer belt 6, a wrap-out roll 16 for specifying the wrap position of the intermediate transfer belt 6 on the downstream side of the wrap position, a backup roll 17 in contact with the secondary transfer roll 8 through the intermediate transfer belt 6, a first cleaning backup roll 19 opposed to a cleaning unit 18 for cleaning the intermediate transfer belt 6, and a second cleaning backup roll 20.

The intermediate transfer belt 6 is stretched among plural rolls 7, 15–17, 19 and 20 as described above. In this embodiment, the stretched intermediate transfer belt 6 is designed to have a substantially flat, long and narrow trapezoidal shape in section in order to miniaturize the full color printer body 1.

Further, in this embodiment, as shown in FIG. 2, the rotary development unit 5 occupies a large space of the full color printer body 1 though the full color printer as a whole is made as small as possible. Accordingly, the full color printer body 1 is designed to be miniaturized while the performance of maintenance of the intermediate transfer belt 6, the rotary development unit 5, etc. is improved. Specifically, the intermediate transfer belt 6 including the photoconductor drum 2, the charging roll 3 and the secondary transfer roll 8 forms an image forming unit 21 integrally. When an upper cover 22 of the full color printer body 1 is opened, the image forming unit 21 as a whole can be removably attached to the full color printer body 1. In addition, a density sensor 23 constituted by a reflective photo-sensor for detecting the patch density of toner formed on the intermediate transfer belt 6 is disposed above the intermediate transfer belt 6.

As shown in FIG. 3, the cleaning unit 18 for the intermediate transfer belt 6 includes a scraper 24 and a cleaning brush 25. The scraper 24 is disposed in contact with the surface of the intermediate transfer belt 6 stretched by the first cleaning backup roll 19. The cleaning brush 25 is disposed in pressure contact with the surface of the intermediate transfer belt 6 stretched by the second cleaning backup roll 20. Residual toner or paper powder removed by the scraper 24 or the cleaning brush 25 is collected inside the cleaning unit 18. Incidentally, the cleaning unit 18 is supported swingably around a swinging shaft 26 counterclockwise in FIG. 3. The cleaning unit 18 is designed to be retracted in a position separate from the surface of the intermediate transfer belt 6 and to abut against the surface of the intermediate transfer belt 6 at given timing.

Each of the secondary transfer roll 8 and the cleaning unit 18 is designed to abut against the surface of the intermediate transfer belt 6 at given timing so as to serve as a load unit applying a load onto the intermediate transfer belt 6. The load on the intermediate transfer belt 6 fluctuates whenever one or both of the secondary transfer roll 8 and the cleaning unit 18 abut against or separate from the surface of the intermediate transfer belt 6.

Further, the recording paper 9 to which the toner images have been transferred from the intermediate transfer belt 6 is conveyed to a fuser 27 as shown in FIG. 2. The toner images are fixed onto the recording paper 9 by the heat and pressure of the fuser 27. In the case of a single-sided print, the recording paper 9 is discharged directly onto a paper delivery tray 29 provided on the top of the printer body 1 by a paper delivery roll 28.

On the other hand, in the case of a double-sided print, the recording paper 9 on which the toner images have been fixed by the fuser 27 is not discharged directly onto the paper delivery tray 29 by the paper delivery roll 28. In the state where the rear end portion of the recording paper 9 is nipped by the paper delivery roll 28, the paper delivery roll 28 is rotated backward while the conveyance path of the recording paper 9 is switched to a double-sided paper conveyance path 30. The recording paper 9 turned over is conveyed to the secondary transfer position of the intermediate transfer belt 6 again by conveyance rolls 31 disposed in the double-sided paper conveyance path 30. Thus, an image is formed on the back side of the recording paper 9.

Further, in the full color printer, as shown in FIG. 2, a manual paper feed tray 32 can be openably attached to a side surface of the printer body 1 optionally. Recording paper 9 of a desired size and a desired kind is placed on the manual paper feed tray 32. The recording paper 9 is fed by a paper feed roll 33 and conveyed to the secondary transfer position of the intermediate transfer belt 6 by the conveyance rolls 31 and the registration roll 14. Thus, an image can be formed on the recording paper 9 of a desired size and a desired kind.

Incidentally, after the step of transferring the toner images is terminated, residual toner or the like is removed from the surface of the photoconductor drum 2 by a cleaning blade 35 of the cleaning unit 34 disposed obliquely under the photoconductor drum 2 whenever the photoconductor drum 2 makes one rotation. Thus, the photoconductor drum 2 is ready for the next image forming process.

In this embodiment, image forming apparatus includes a photoconductor, a drive unit for driving and rotating the photoconductor, an exposure unit for performing image exposure on the photoconductor to thereby form a latent image, plural development units for developing plural latent images formed in turn on the photoconductor with toners of different colors respectively, a belt-like intermediate transferor driven by the photoconductor so that toner images of plural colors developed in turn on the photoconductor are superimposed on one another and primary-transferred to the belt-like intermediate transferor, and at least one load unit for abutting against or separating from the belt-like intermediate transferor to thereby give a fluctuation to the load on the belt-like intermediate transferor. In the image forming apparatus, an elastic belt is used as the belt-like intermediate transferor, and a velocity control unit is provided for increasing/decreasing the driving velocity of the photoconductor at given timing.

In addition, in this embodiment, the velocity control unit is designed so that the driving velocity of the photoconductor in a part of or all of a period when at least a latent image of one color is formed is made different from that in a period when a latent image of another color is formed.

Further, in this embodiment, the velocity control unit is designed to increase/decrease the driving velocity of the photoconductor between the beginning of forming a latent image of the first color and the completion of transferring a toner image of the first color and in response to the timing when the load unit in contact with the belt-like intermediate transferor leaves the belt-like intermediate transferor.

Moreover, in this embodiment, the velocity control unit is designed to increase/decrease the driving velocity of the photoconductor between the beginning of forming a latent image of the last color and the completion of transferring a toner image of the last color and in response to the timing when the load unit separated from the belt-like intermediate transferor abuts against the belt-like intermediate transferor.

Figure 4:
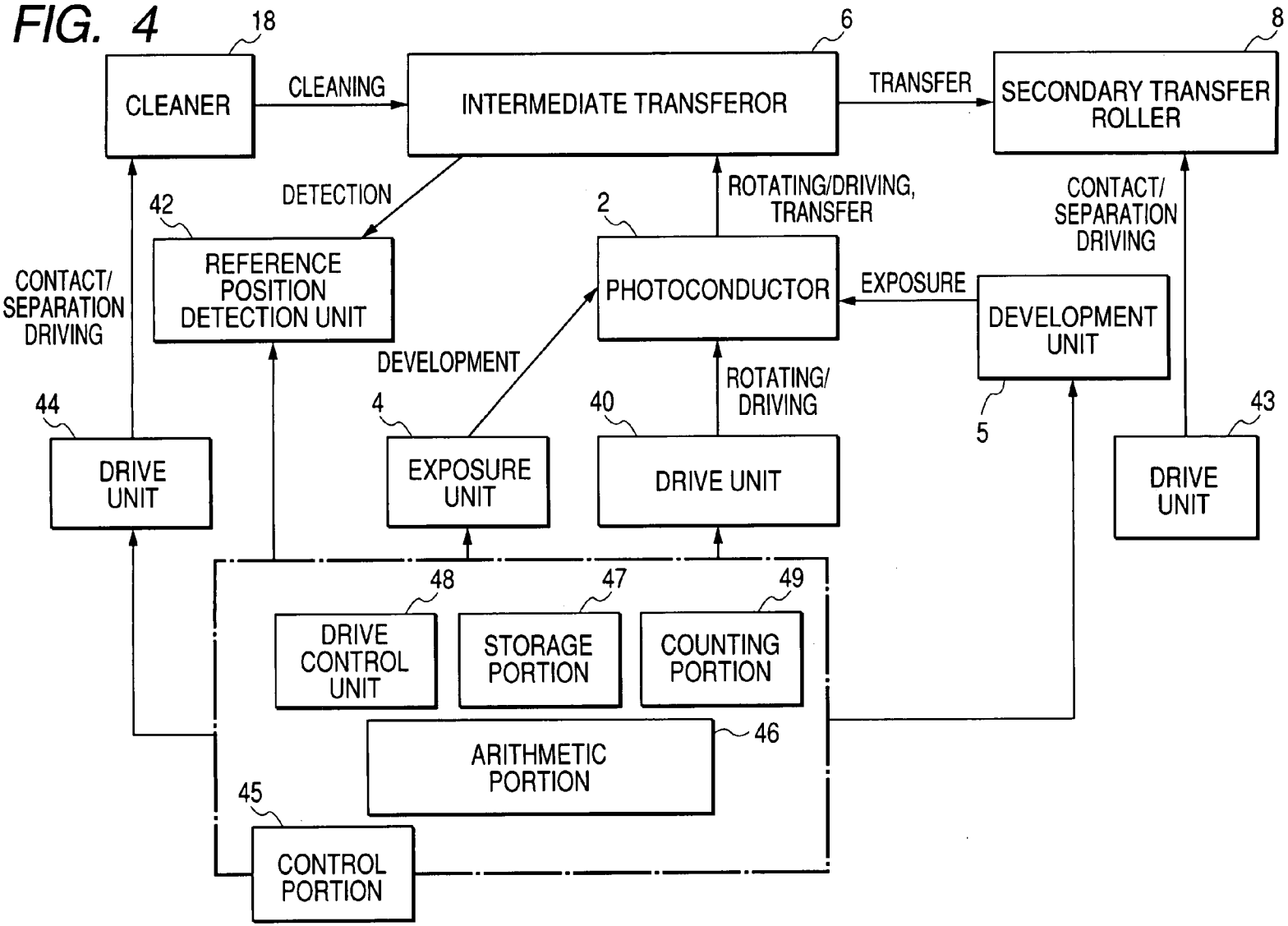
FIG. 4 is a block diagram showing a control portion of the full color printer as image forming apparatus according to the first embodiment of the invention.

FIG. 4 is a block diagram showing a control circuit of the full color printer according to this embodiment together with the configuration of the hardware thereof.

That is, in the full color printer according to this embodiment, as shown in FIG. 4, the photoconductor drum 2 is designed to be driven to rotate at a predetermined peripheral velocity (about 150 mm/sec) directly or through plural gears or the like by a drive motor 40 serving as a first drive unit and made of a stepping motor or the like. In addition, the intermediate transfer belt 6 wound on the surface of the photoconductor drum 2 is designed to be driven to rotate by the photoconductor drum 2.

Figure 5:
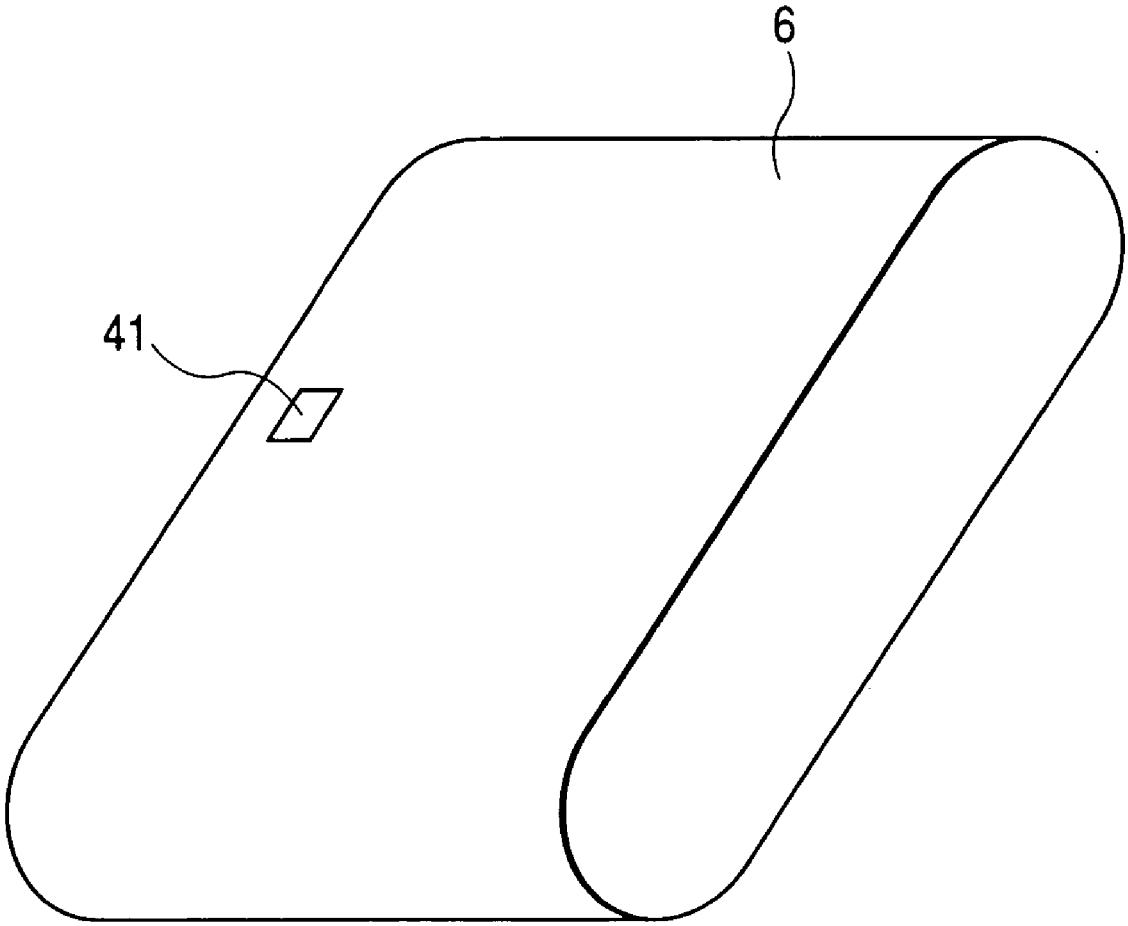
FIG. 5 is a perspective configuration view showing a reference position mark provided in an intermediate transfer belt.

In addition, as shown in FIG. 5, a rectangular reference position mark 41 for detecting the rotation period of the intermediate transfer belt 6 is provided in a width-direction end portion of the surface of the intermediate transfer belt 6 by fusion-bonding of synthetic resin and aluminum or the like so as to reflect light. As shown in FIG. 3, the reference position mark 41 is detected by a reference position detection unit 42 disposed along the circulating path of the intermediate transfer belt 6 and near the bottom of the intermediate transfer belt 6. The reference position detection unit 42 is made of a reflective photo-sensor or the like.

Further, as shown in FIG. 4, the secondary transfer roll 8 is designed to touch and leave the surface of the intermediate transfer belt 6 at given timing by an eccentric cam or the like driven by a second drive unit 43. On the other hand, the cleaning unit 18 is designed to touch and leave the surface of the intermediate transfer belt 6 at given timing by an eccentric cam or the like driven by a third drive unit 44.

In addition, in the full color printer, a control portion 45 also has a function of a color misregistration detection pattern forming unit which will be described later. As shown in FIG. 4, the control portion 45 includes an arithmetic portion 46, a storage portion 47, a drive control unit 48 and a counting portion 49. The arithmetic portion 46 is constituted by a CPU or the like. The storage portion 47 is constituted by an NVM or the like for storing predetermined programs, parameters, etc. The drive control unit 48 controls the first to third drive units 40, 43 and 44. The counting portion 49 is constituted by a clock counter or the like for counting the period with which the reference position mark 41 is detected by the reference position detection unit 42.

In addition, in this embodiment, the image forming apparatus includes an image carrier, shaped like a belt, that holds toner images of plural colors, and a transfer portion that transfers the toner images of plural colors held on the image carrier onto a recording medium, wherein the image carrier is rotatablly disposed toward the image carrier and has elasticity in a rotating direction toward the image carrier. The image forming apparatus further includes a pattern image forming unit that repeatedly forms a pattern image for color misregistration detection on the image carrier at a constant interval so as to set the pattern images within the length range of the recording medium in the rotating direction of the image carrier, wherein which one of the pattern images includes a first toner image group in which plural toner images of a first color are formed at a first interval in the rotating direction of the image carrier, and a second toner image group in which plural toner images of a second color are formed at a second interval in the rotating direction of the image carrier. Furthermore, the second interval is different from the first interval, and the second toner image group is closed to the first toner image group. For example, a so-called ladder chart in which plural line segments formed in a direction perpendicular to the rotating direction of the image carrier are disposed in the rotating direction of the image carrier is used as the toner images.

Further, in this embodiment, the second interval is different from the first interval, and the second toner image group is superimposed on the first toner image group at same position.

Figure 1A:
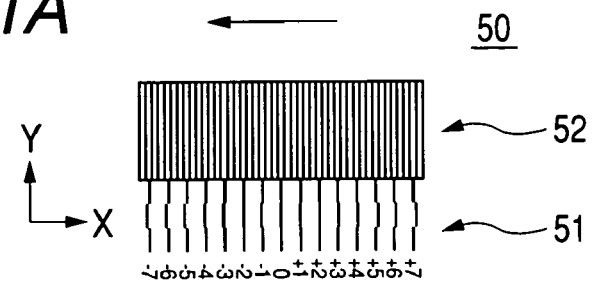
FIGS. 1A to 1C are configuration views of color misregistration detection toner images to be used in a full color printer as image forming apparatus according to a first embodiment of the invention.
Figure 6:
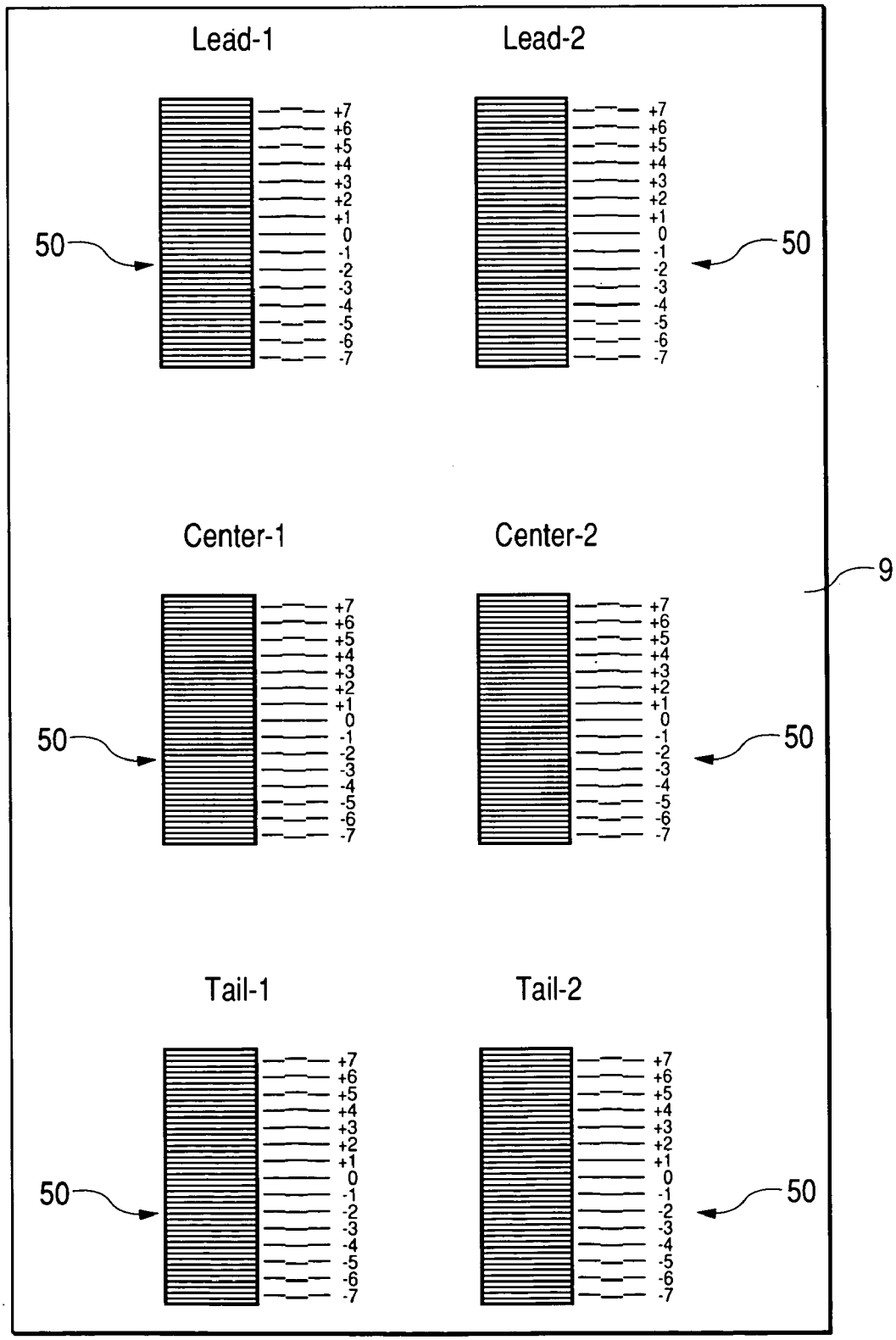
FIG. 6 is a configuration view showing the state where the color misregistration detection toner images to be used in the full color printer as image forming apparatus according to the first embodiment of the invention have been formed on paper.

That is, in this embodiment, as shown in FIG. 1A, a pattern image 50 for detecting color misregistration is constituted by a pair of color misregistration detection pattern images 51 and another kind of pair of color misregistration detection pattern images 52 formed on the intermediate transfer belt 6 as a belt-like image carrier. As shown in FIG. 6, each pair of color misregistration detection pattern images 51 and 52 is formed to be repeated at a predetermined interval plural times (three times in the illustrated example) so as to be set within the length range of the recording paper 9 as a recording medium. The pairs of color misregistration detection pattern images 51 and 52 transferred onto the intermediate transfer belt 6 are secondary-transferred onto the recording paper 9 in the secondary transfer position.

Figure 1B:
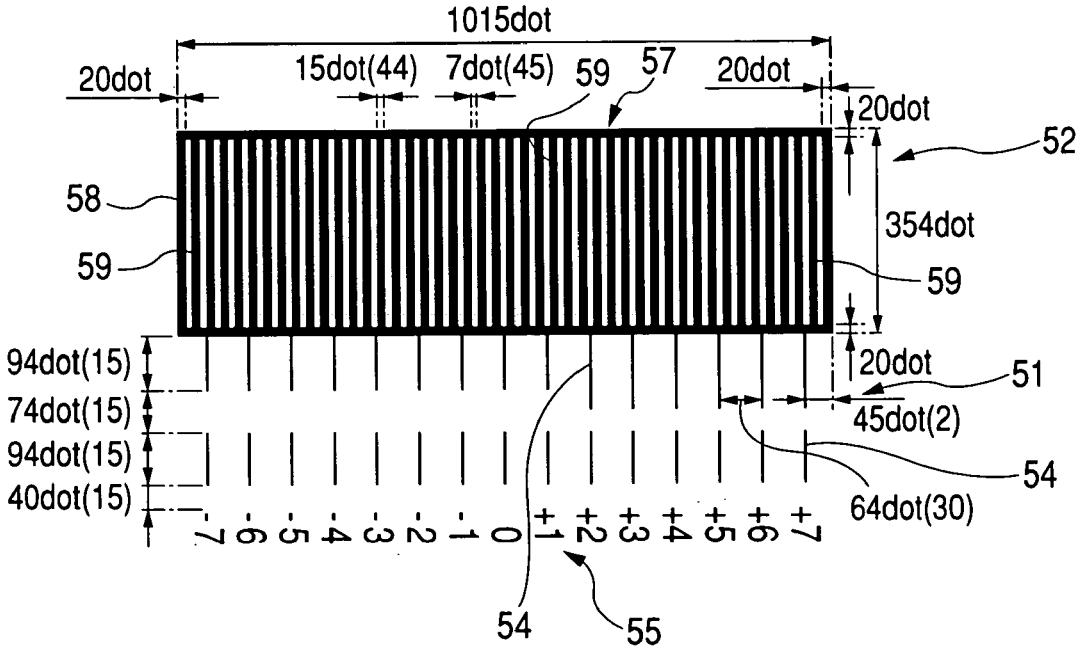
Figure 1C:
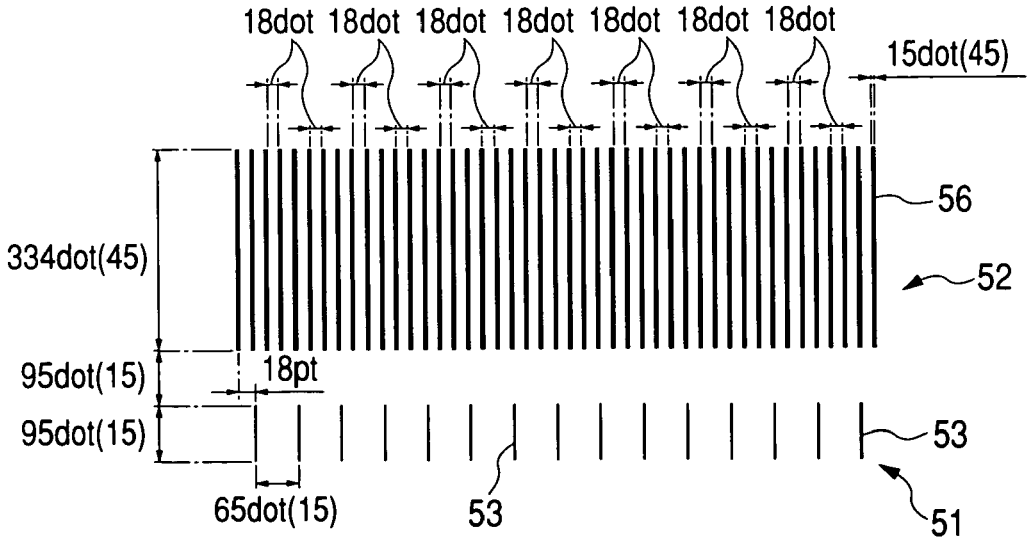
Figure 7:
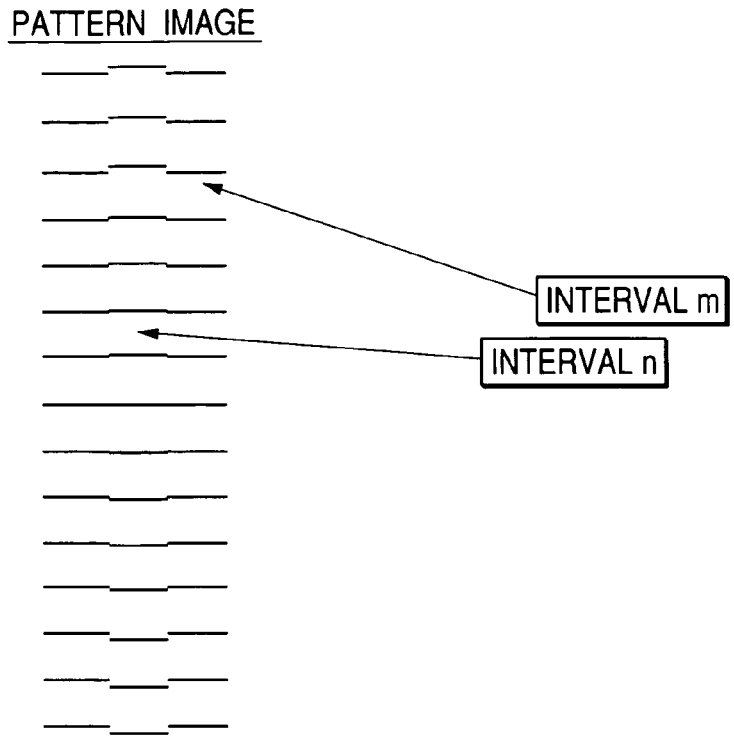
FIG. 7 is a configuration view showing the color misregistration detection toner images to be used in the full color printer as image forming apparatus according to the first embodiment of the invention.

Of the pairs of color misregistration detecting pattern images 51 and 52, the pair of color misregistration detecting pattern images 51 is constituted by a toner image 53 for detecting color misregistration of one color and a toner image 54 for detecting color misregistration of another color as shown in FIGS. 1B–1C and FIG. 7. The toner image 53 is formed like straight lines at a predetermined interval (e.g. 64 dots) in the rotating direction of the intermediate transfer belt 6. The toner image 54 is formed like straight lines at an interval (e.g. 65 dots) difference from the predetermined interval and closely to the opposite, left and right sides of the toner image 53 for detecting color misregistration of one color. The toner image 53 for detecting color misregistration of one color and the toner image 54 for detecting color misregistration of another color are, for example, set to have a line width of 2 dots and a length of 94 dots. The toner image 53 for detecting color misregistration of one color is, for example, formed out of yellow and black. On the other hand, the toner image 54 for detecting color misregistration of another color is, for example, formed out of magenta and cyan. Further, a scale 55 is added to the toner image 54 for detecting color misregistration of another color as follows. That is, "0" is placed in the central portion of the scale 55 in the rotating direction of the intermediate transfer belt 6, and "+1", "+2", . . . line up upstream likewise while "−1", "−2", . . . line up downstream likewise. When there occurs misregistration in the X direction between a yellow toner image and a black toner image, lines in a position on the scale 55 corresponding to the distance of the misregistration are aligned in a straight line. On the other hand, the pair of color misregistration detection pattern images 51 is formed in a lead position located in the upper end portion of the recording paper 9, a center position located in the central portion of the same, and a tail position located in the lower end portion of the same, as illustrated. In addition, a pattern image constituted by a combination of yellow that is a color to be detected and magenta that is a reference color is formed on the left side of the recording paper 9. On the right side of the recording paper 9, a pattern image constituted by a combination of black that is a color to be detected and cyan that is a reference color is formed. The combinations of colors are selected in consideration of visual distinguish ability.

Figure 8:
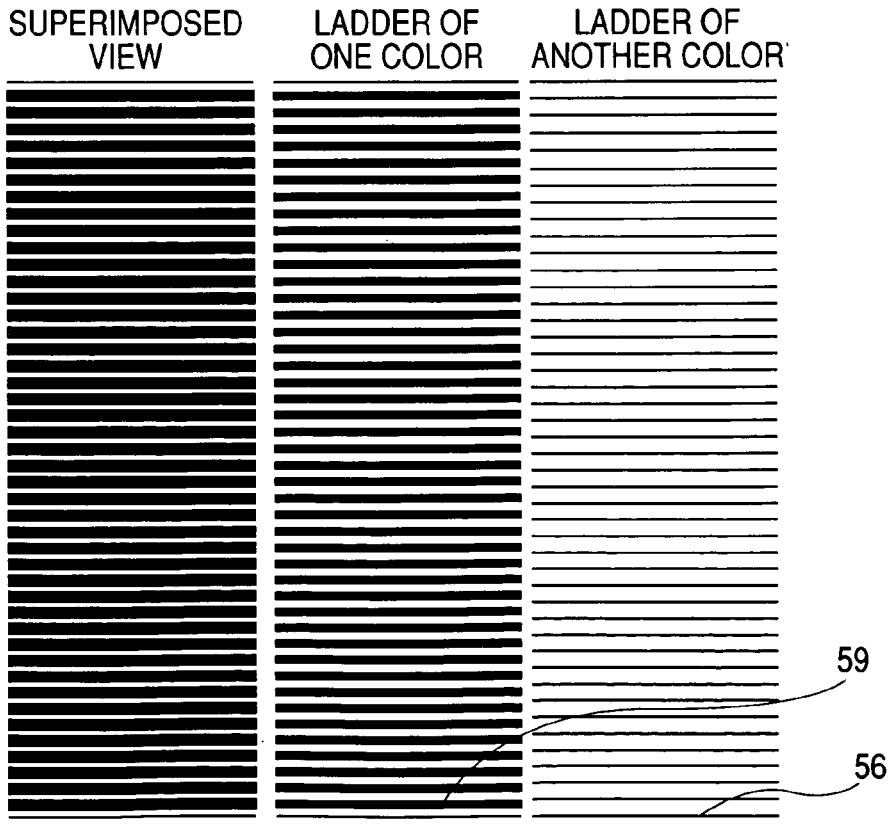
FIG. 8 is a configuration view showing the color misregistration detection toner images to be used in the full color printer as image forming apparatus according to the first embodiment of the invention.
Figure 20:
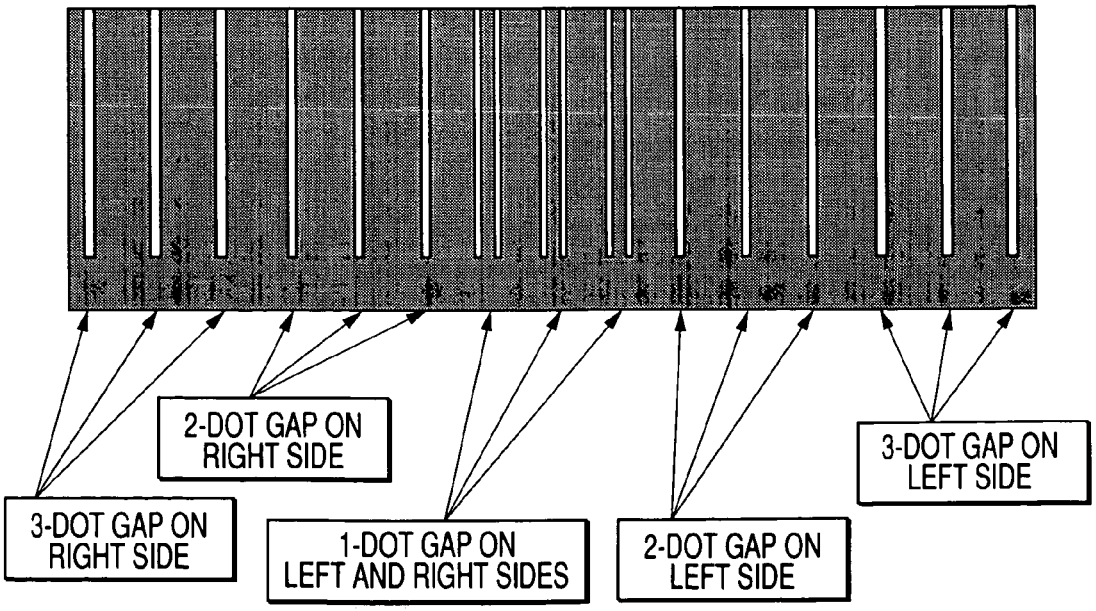
FIG. 20 is a configuration view showing the color misregistration detection toner images to be used in the full color printer as image forming apparatus according to the first embodiment of the invention.

On the other hand, the pair of color misregistration detecting pattern images 52 is formed adjacently to the pattern images 51 as shown in FIG. 1A. As shown in FIGS. 1B–1C and FIG. 8, the pair of color misregistration detecting pattern images 52 is constituted by a toner image 56 for detecting color misregistration of one color and a toner image 57 for detecting color misregistration of another color. The toner image 56 is formed like straight lines at a predetermined interval in the rotating direction of the intermediate transfer belt 6. The toner image 57 is formed like straight lines at an interval different from the predetermined interval, and superimposed on the toner image 56 for detecting color misregistration of one color. The toner image 56 for detecting color misregistration of one color is, for example, set to have a line width of 5 dots and a length of 334 dots. In addition, the toner image 56 for detecting color misregistration of one color is formed to have lines at a predetermined interval (e.g. 17 dots) in the rotating direction of the intermediate transfer belt 6 fundamentally, and to have an interval of 18 dots on every second line. The intervals are set as follows. Assume that there occurs color misregistration between one color and another actually when the toner images shown in FIGS. 1B and 1C are superimposed. Even in this case, as shown in FIG. 20, there always appear three consecutive portions in each of which a portion of the two colors superimposed on each other has gaps of one dot equally on its left and right sides. Accordingly, setting is done so that the color in the central one of the three portions can be visually recognized as the position of the centroid of the color, and the position of the centroid can be judged to indicate the distance of color misregistration. The toner image 56 for detecting color misregistration of one color is, for example, formed out of yellow and black. On the other hand, the toner image 57 for detecting color misregistration of another color is, for example, formed out of magenta and cyan.

In addition, as shown in FIGS. 1B–1C and FIG. 8, the circumference of the toner image 57 for detecting color misregistration of another color is formed into a rectangular frame 58 of a thick line having a line width of 20 dots, while a ladder chart 59 formed like straight lines each having a line width of 15 dots and perpendicular to the rotating direction of the intermediate transfer belt 6 is formed inside the rectangular frame 58 so that the lines of the ladder chart 59 are arranged at a predetermined interval (e.g. 7 dots) in the rotating direction of the intermediate transfer belt 6. Each straight line of the image 59 is, for example, set to be 354 dots long. The left end portion of the rectangular frame 58 is disposed at a distance of 84 mm from an end portion of the A-4 size paper 9 in the X-direction.

As shown in FIG. 8, the toner image 56 for detecting color misregistration of one color and the toner image 57 for detecting color misregistration of another color are formed to be superimposed on each other so that the images in their central portions will agree with each other if there is no color misregistration.

Accordingly, as shown in FIG. 8, the toner image 56 for detecting color misregistration of one color and the toner image 57 for detecting color misregistration of another color are arranged so that a line of the toner image for detecting color misregistration of one color located at the center (the position of "0" on the scale) will be placed in a gap between lines of the toner image for detecting color misregistration of another color located at the center if there is no color misregistration.

In the full color printer configured thus according to this embodiment, the occurrence of color misregistration in the process direction can be detected visually in the following manner even when the operation of the cleaning unit or the secondary transfer roll touching/leaving from the surface of the intermediate transferor is inserted into the image formation operation.

That is, in the full color printer according to this embodiment, a process control operation is carried out at predetermined timing so as to control toner images of respective colors to have a predetermined density equally. This process control operation is carried out at predetermined timing, for example, as soon as power is supplied to the printer, as soon as the number of prints reaches a predetermined number, as soon as the rotation number of the photoconductor drum 2 reaches a predetermined value, or as soon as the temperature or humidity inside the printer body 1 has a change of a predetermined value or higher. The process control operation is executed as follows. That is, patches made of toner images of respective colors of yellow (Y), magenta (M), cyan (C) and black (K) are formed on the photoconductor drum 2 so as to have a density of a predetermined value such as 30% or 50%. The toner patches of the respective colors formed on the photoconductor drum 2 are transferred onto the intermediate transfer belt 6. As shown in FIG. 2, the toner patches of the respective colors in that state are read by the density sensor 23. The toner density or the development bias potential in the developing devices 5Y, 5M, 5C and 5K, the charging potential of the photoconductor drum 2 or the exposure value of the ROS 4 is adjusted by the arithmetic portion 46 so that a predetermined image density can be obtained.

At the same time as the process control operation, the operation of measuring a period TR0 is carried out. The period TR0 is a rotation period of the intermediate transfer belt 6. Incidentally, the operation of measuring the period TR0 which is a rotation period of the intermediate transfer belt 6 may be designed to be carried out when the process control operation is not active. In the operation of measuring the rotation period of the intermediate transfer belt 6, as shown in Step 101 in FIG. 9, the following process is first performed. That is, the cleaning unit 18 for the intermediate transfer belt 6 is separated therefrom, while the reference position mark 41 provided in the surface of the intermediate transfer belt 6 is detected by the reference position detecting unit 42 with the secondary transfer roll 8 being separated from the intermediate transfer belt 6. Thus, a cycle for obtaining the period TR0 in the form of a pulse signal outputted from the reference position detection unit 42 is repeated n times (e.g. n=1) to obtain an average value TR0_Ave of the period TR0. The obtained average value TR0_Ave of the period TR0 corresponds to a rotation period TR0_MC of the intermediate transfer belt 6 in the image formation operation of magenta and cyan in which image formation is carried out with the cleaning unit 18 and the second transfer roll 8 away from the intermediate transfer belt 6. Incidentally, the value n is normally set to be "1" as described above. In this case, the processing for obtaining the average value is not necessary.

Figure 10:
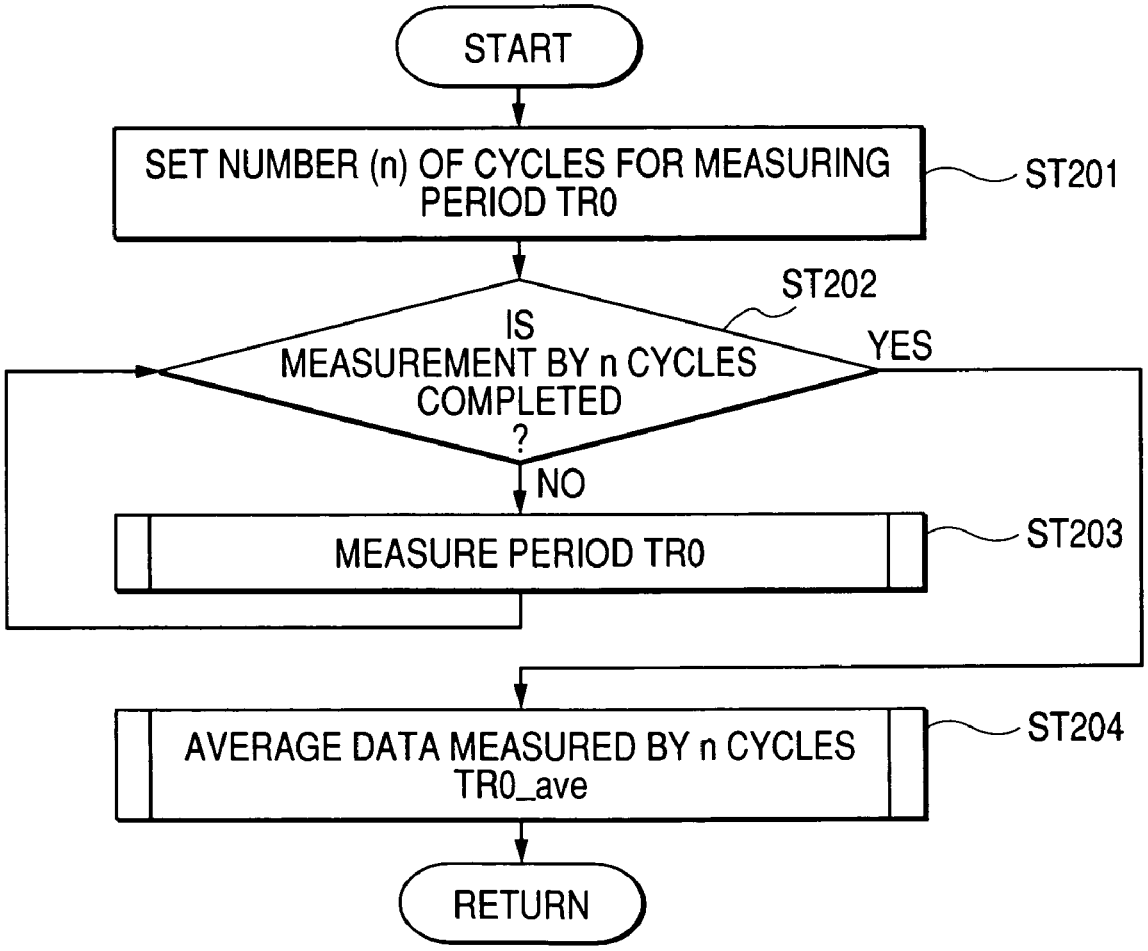
FIG. 10 is a flow chart showing the operation of the control portion of the full color printer as image forming apparatus according to the first embodiment of the invention.

As for the average value TR0_Ave of the period TR0, as shown in FIG. 10, the value n which is the number of cycles for measuring the period TR0 is set by the control portion 45 (Step 201), and it is judged whether the measurement by the set number n of cycles is completed or not (Step 202). When it is concluded that the measurement by the set number n of cycles is not completed, the control portion 45 carries out the operation of measuring the period TR0 (Step 203). When the measurement by the set number n of cycles is completed, the processing for calculating the average value TR0_Ave of data measured by the number n of cycles is carried out.

Figure 11:
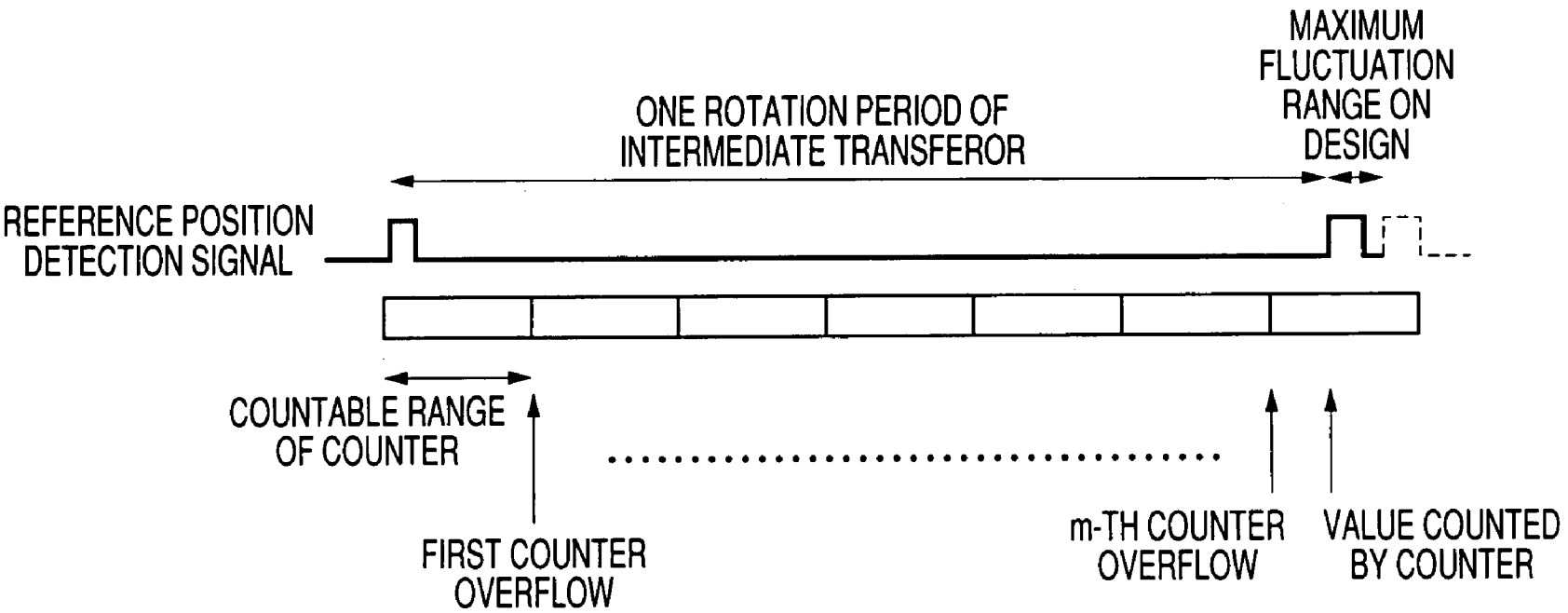
FIG. 11 is an explanatory view showing the operation of the control portion of the full color printer as image forming apparatus according to the first embodiment of the invention.

In that event, the period of the TR0 signal outputted from the reference position detection unit 42 is detected as shown in FIG. 11. That is, a counter for counting a reference clock is used as the counting portion 49 so as to count the time between the TR0 signal and the next TR0 signal outputted from the reference position detection unit 42. Incidentally, the time the counter as the counting portion 49 can measure is set to be shorter than the detectable period of the TR0 signal. Accordingly, the counter is set to keep counting while repeating overflow, and measure the time till the TR0 signal is detected after m overflows on design. The number m of overflows of the counter can be beforehand grasped on design. Accordingly, when the time measured since the start of measuring and till one overflow is multiplied by m and the product obtained thus is added to the time measured after m overflows, the period of the detection signal of the reference position mark 41 can be measured. Therefore, in view of design, any counter may be used as the aforementioned counter if it is necessary and sufficient to measure a tolerance range of the detection period which can be grasped in advance.

Figure 9:
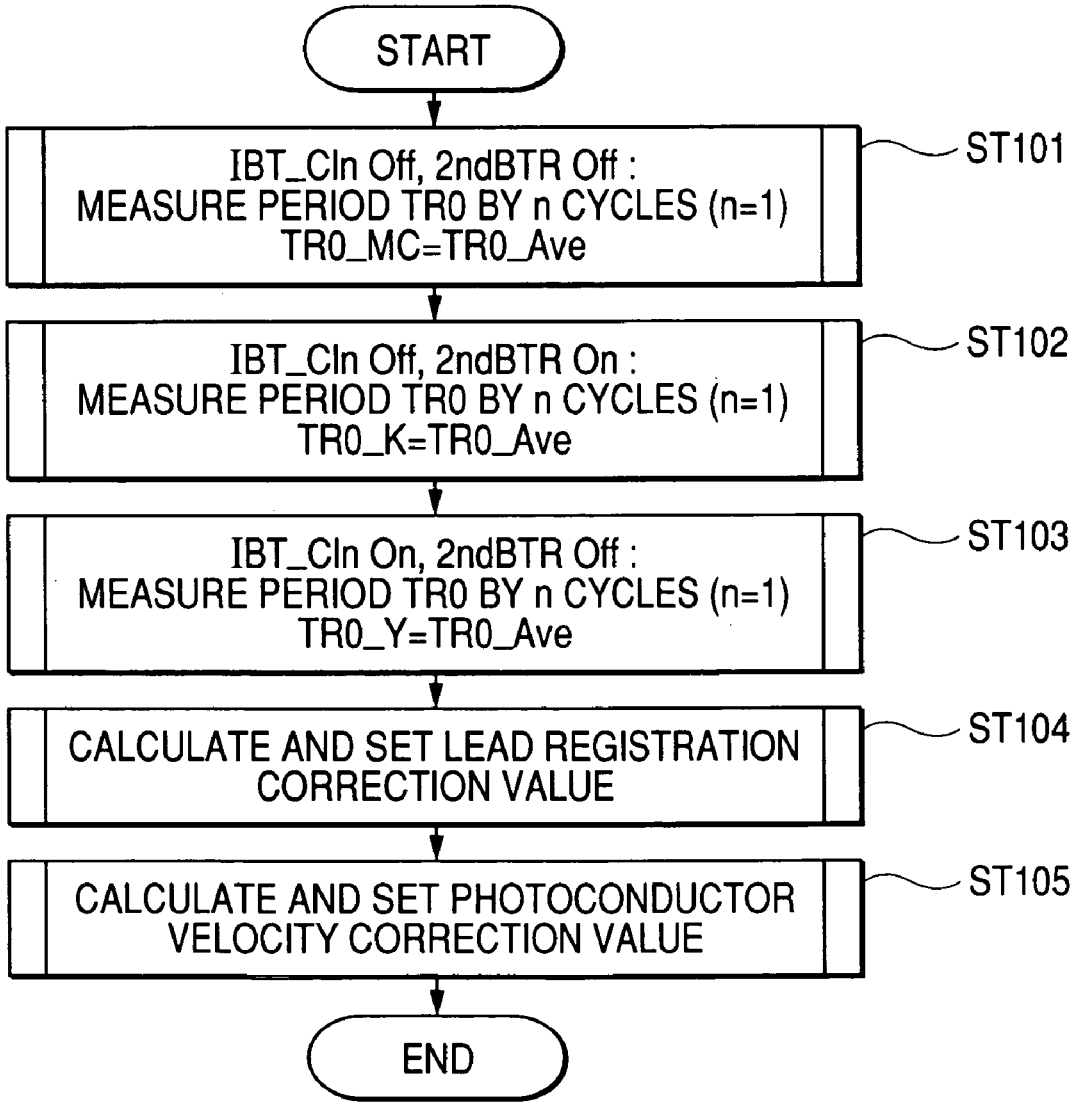
FIG. 9 is a flow chart showing the operation of the control portion of the full color printer as image forming apparatus according to the first embodiment of the invention.

Next, as shown in Step 102 in FIG. 9, the control portion 45 repeats measuring by n cycles (e.g. n=1) with the cleaning unit 18 away from the intermediate transfer belt 6 and with the secondary transfer roll 8 in contact with the intermediate transfer belt 6. Thus, an average value TR0_K of the period TR0 is obtained. The obtained average value TR0_K of the period TR0 corresponds to the operation of black image formation in which image formation is performed with the secondary transfer roll 8 in contact with the intermediate transfer drum 6.

After that, as shown in Step 103 in FIG. 9, the control portion 45 makes control to repeat measuring by n cycles (e.g. n=1) with the cleaning unit 18 in contact with the intermediate transfer belt 6 and with the secondary transfer roll 8 away from the intermediate transfer belt 6. Thus, an average value TR0_Y of the period TR0 is obtained. The obtained average value TR0_Y of the period TR0 corresponds to the operation of yellow image formation in which image formation is performed with the cleaning unit 18 in contact with the intermediate transfer drum 6.

Based on the measured values TR0_MC, TR0_K and TR0_Y measured as described above, the control portion 45 calculates and sets correction values of lead registration, and calculates and sets correction values of the driving velocity of the photoconductor drum 2 (Step 104 and Step 105).

The processing for calculating the correction values of the driving velocity of the photoconductor drum 2 is performed as follows.

Based on the measured values TR0_MC, TR0_K and TR0_Y of the TR0 period, and predetermined photoconductor velocity correction calculation coefficients PR Vel_Coef_Y1A, PR Vel_Coef_Y1B, PR Vel_Coef_Y2A, PR Vel_Coef_Y2B, PR Vel_Coef_K1A, and PR Vel_Coef_K1B stored in the storage portion 47, the arithmetic portion 46 of the control portion 45 calculates photoconductor velocity automatic-mode correction values PR_Vel_Y1A, PR_Vel_Y1B, PR_Vel_Y2A, PR_Vel_Y2B, PR_Vel_K1A and PR_Vel_K1B in accordance with the following expressions.

$$PR_Vel_Y1A=(TR0_MC-TR0_Y)/PR\ Vel_Coef_Y1A$$

$$PR_Vel_Y1B=(TR0_MC-TR0_Y)/PR\ Vel_Coef_Y1B$$

$$PR_Vel_Y2A=(TR0_MC-TR0_Y)/PR\ Vel_Coef_Y2A$$

$$PR_Vel_Y2B=(TR0_MC-TR0_Y)/PR\ Vel_Coef_Y2B$$

$$PR_Vel_K1A=(TR0_MC-TR0_K)/PR\ Vel_Coef_K1A$$

$$PR_Vel_K1B=(TR0_MC-TR0_K)/PR\ Vel_Coef_K1B$$

In addition, based on the measured values TR0_MC, TR0_K and TR0_Y of the TR0 period, and predetermined lead registration correction calculation coefficients Lead_Reg_Coef_Y1, Lead_Reg_Coef_Y2, and Lead_Reg- _Coef_K1 stored in the storage portion 47, the arithmetic portion 46 of the control portion 45 calculates lead registration automatic-mode correction values Lead_Reg_Y1, Lead_Reg_Y2 and Lead_Reg_K1 in accordance with the following expressions.

$$Lead_Reg_Y1=(TR0_Y-TR0_MC)\times Lead_Reg_Coef_Y1/1000$$

$$Lead_Reg_Y2=(TR0_Y-TR0_MC)\times Lead_Reg_Coef_Y2/1000$$

$$Lead_Reg_K1=(TR0_K-TR0_MC)\times Lead_Reg_Coef_K1/1000$$

In the full color printer according to this embodiment, a manual mode is provided in addition to the automatic mode for correction.

Figure 12:
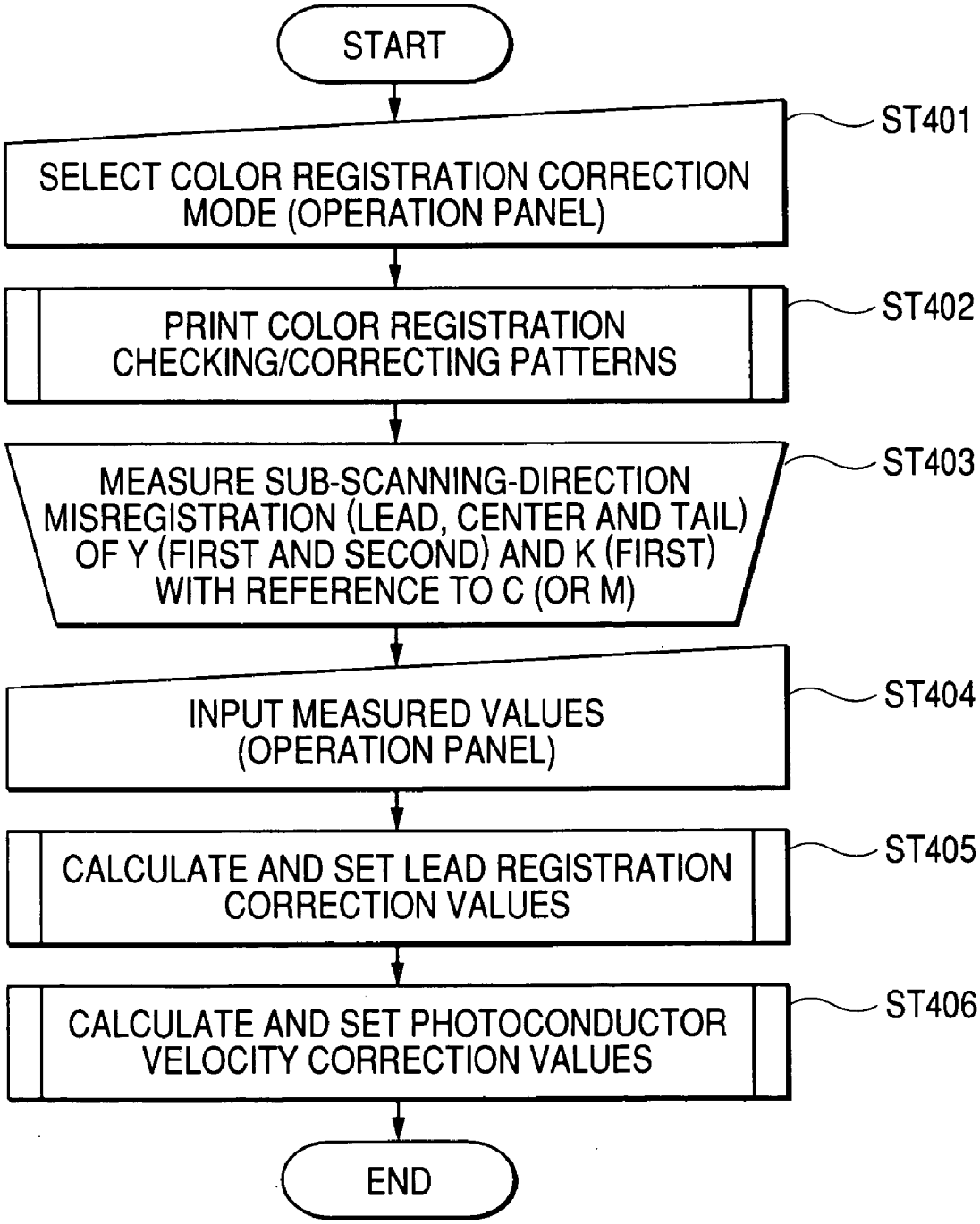
FIG. 12 is a flow chart showing the operation of the control portion of the full color printer as image forming apparatus according to the first embodiment of the invention.

In this manual mode, as shown in Step 401 in FIG. 12, an operator handles an operation panel of the printer to select a color registration correction mode. Next, the operator prints a color registration check/correction pattern onto the recording paper 9 by the full color printer as shown in FIG. 6 (Step 402). Based on sheets of print samples, the operator measures a sub-scanning-direction misregistration of yellow from the first and second sheets and a sub-scanning-direction misregistration of black from the first sheet with reference to cyan and magenta. Each misregistration is measured visually in three portions, that is, lead, center and tail portions (Step 403).

Correction values to be inputted in the manual mode include Color_Reg_Y1L, Color_Reg_Y1C, Color_Reg_Y1T, Color_Reg_K1L, Color_Reg_K1C, Color_Reg_K1T, Color_Reg_Y2L, Color_Reg_Y2C and Color_Reg_Y2T.

After that, the operator handles the operation panel to input the measured color misregistration values read from the print samples (Step 404). Then, the arithmetic portion 46 of the control portion 45 calculates and sets lead registration correction values (Step 405) and calculates and sets photoconductor velocity correction values (Step 406) as will be described later. Incidentally, on the print samples, downward misregistration is regarded as positive and upward misregistration is regarded as negative. The operator inputs a correction value. A negative correction value is inputted for positive misregistration so as to compensate it. The arithmetic portion 46 performs a correction operation using the correction value set in the manual mode as described above, and stores the obtained data into the storage portion 47 independently of the data obtained in the automatic mode.

Figure 13:
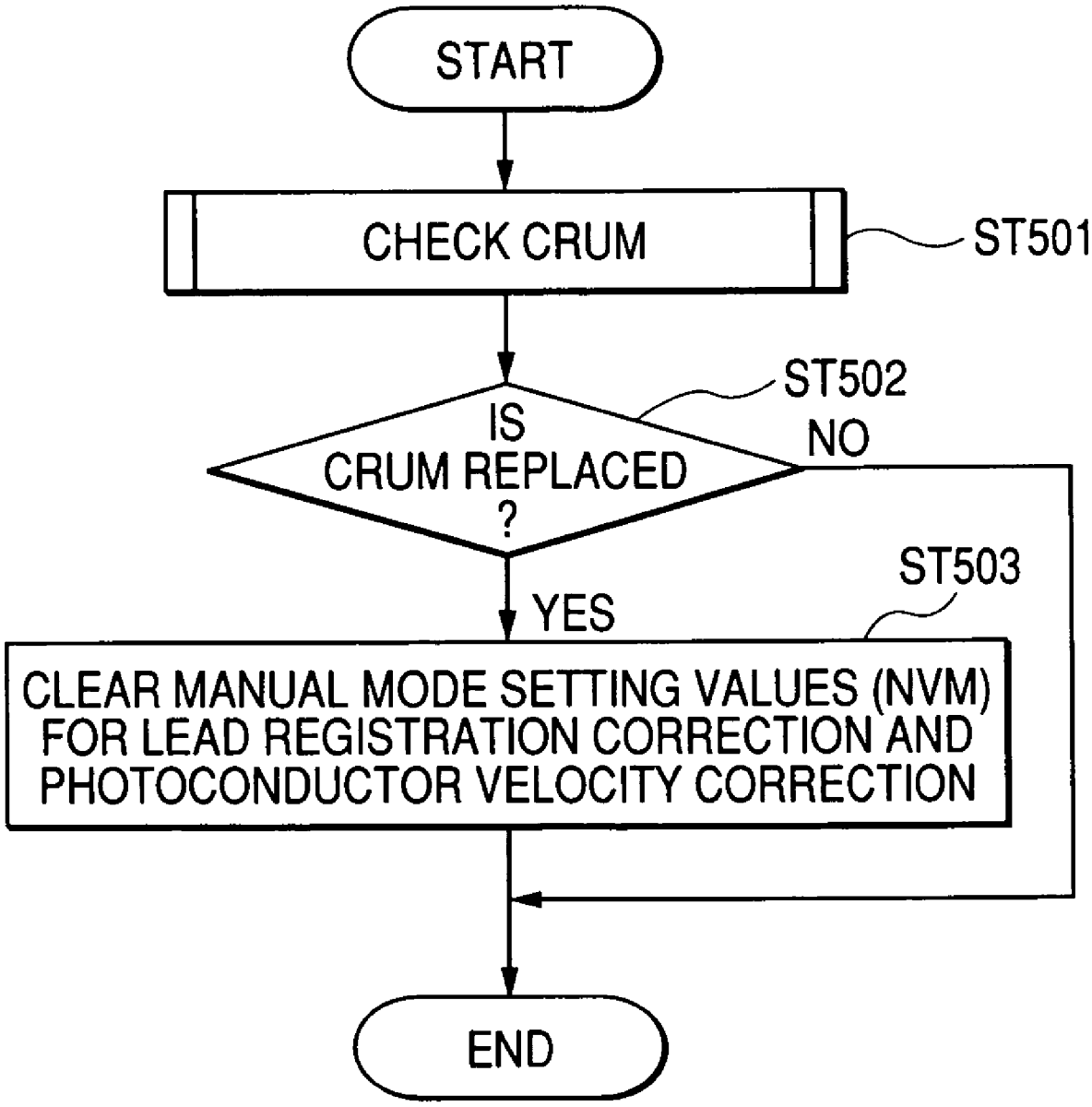
FIG. 13 is a flow chart showing the operation of the control portion of the full color printer as image forming apparatus according to the first embodiment of the invention.

As shown in FIG. 13, the data stored in the storage portion 47 is retained till the replacement of a photoconductor and intermediate transfer belt unit is detected in recognition check of a memory chip (CRUM) for identifying the photoconductor and intermediate transfer belt unit or till correction is made again in the manual mode. In addition, the correction data set in the manual mode is used to be added to the set value in the automatic mode.

In the check operation, as shown in FIG. 13, the control portion 45 checks the memory chip attached to the photoconductor and intermediate transfer belt unit (Step 501), and judges whether the photoconductor and intermediate transfer belt unit has been replaced or not (Step 502). When the control portion 45 concludes that the photoconductor and intermediate transfer belt unit has not been replaced, the control portion 45 terminates the check operation. When the control portion 45 concludes that the photoconductor and intermediate transfer belt unit has been replaced, the control portion 45 clears the set values (NVM) of the manual mode for correcting the lead registration and the photoconductor velocity (Step 503).

Based on the correction values Color_Reg_Y1L, Color_Reg_Y1C, Color_Reg_Y1T, Color_Reg_K1L, Color_Reg_K1C, Color_Reg_K1T, Color_Reg_Y2L, Color_Reg_Y2C and Color_Reg_Y2T inputted in the manual mode, the arithmetic portion 46 of the control portion 45 calculates correction values PR_Vel_Y1AM, PR_Vel_Y2AM, PR_Vel_Y1BM, PR_Vel_K1AM, PR_Vel_K1BM, PR_Vel_K2AM, PR_Vel_K2BM and PR_Vel_MCM of the photoconductor velocity in the manual mode in accordance with the following expressions.

$$PR_Vel_Y1AM=(Color_Reg_Y1C-Color_Reg_Y1L)\times 42.3\ \mu m/(\text{Lead-to-Center distance } [\mu m])\times 10000[0.01\%]$$

$$PR_Vel_Y1BM=(Color_Reg_Y1C-Color_Reg_Y1L)\times 42.3\ \mu m/(\text{Lead-to-Center distance } [\mu m])\times 10000[0.01\%]$$

$$PR_Vel_Y2AM=(Color_Reg_Y1C-Color_Reg_Y1L)\times 42.3\ \mu m/(\text{Lead-to-Center distance } [\mu m])\times 10000[0.01\%]$$

$$PR_Vel_Y2BM=(Color_Reg_Y1C-Color_Reg_Y1L)\times 42.3\ \mu m/(\text{Lead-to-Center distance } [\mu m])\times 10000[0.01\%]$$

Lead registration automatic-mode correction values Lead_Reg_Y1, Lead_Reg_Y2 and Lead_Reg_K1 are calculated in accordance with the following expressions.

$$Lead_Reg_Y1=(TR0_Y-TR0_MC)\times Lead_Reg_Coef_Y1/1000$$

$$Lead_Reg_Y2=(TR0_Y-TR0_MC)\times Lead_Reg_Coef_Y2/1000$$

$$Lead_Reg_K1=(TR0_K-TR0_MC)\times Lead_Reg_Coef_K1/1000$$

When the aforementioned calculation results includes at least one negative value, the control portion 45 does setting to offset the lead registration of magenta and cyan by the minimum value (the maximum negative value) as follows. When all the calculation results are positive, the processing for calculating the lead registration correction values is terminated.

$$Lead_Reg_MC=-\min(Lead_Reg_Y1, Lead_Reg_Y2, Lead_Reg_K1)$$

Here, $$Lead_Reg_Y1=Lead_Reg_Y1+Lead_Reg_MC$$

$$Lead_Reg_Y2=Lead_Reg_Y2+Lead_Reg_MC$$

$$Lead_Reg_K1=Lead_Reg_K1+Lead_Reg_MC$$

$$PR_Vel_K1AM=(Color_Reg_Y1C-Color_Reg_Y1L)\times 42.3\ \mu m/(\text{Lead-to-Center distance } [\mu m])\times 10000[0.01\%]$$

$$PR_Vel_K1BM=(Color_Reg_Y1C-Color_Reg_Y1L)\times 42.3\ \mu m/(\text{Lead-to-Center distance } [\mu m])\times 10000[0.01\%]$$

In addition, based on the correction values Color_Reg_Y1L, Color_Reg_Y1C, Color_Reg_Y1T, Color_Reg_K1L, Color_Reg_K1C, Color_Reg_K1T, Color_Reg_Y2L, Color_Reg_Y2C and Color_Reg_Y2T inputted in the manual mode, the arithmetic portion 46 of the control portion 45 calculates lead registration manual correction values Lead_Reg_Y1M, Lead_Reg_Y2M, Lead_Reg_K1M, Lead_Reg_K2M and Lead_Reg_MCM in accordance with the following expressions.

$$Lead_Reg_Y1M=Color_Reg_Y1L$$

$$Lead_Reg_Y2M=Color_Reg_Y2L$$

$$Lead_Reg_K1M=Color_Reg_K1L$$

When the aforementioned calculation results includes at least one negative value, the control portion 45 does setting to offset the lead registration of magenta and cyan by the minimum value (the maximum negative value) as follows. When all the calculation results are positive, the processing for calculating the lead registration correction values is terminated.

$$Lead_Reg_MCM=-\min(Lead_Reg_Y1M, Lead_Reg_Y2M, Lead_Reg_K1M)$$

Here, $$Lead_Reg_Y1M=Lead_Reg_Y1M+Lead_Reg_MCM$$

$$Lead_Reg_Y2M=Lead_Reg_Y2M+Lead_Reg_MCM$$

$$Lead_Reg_K1M=Lead_Reg_K1M+Lead_Reg_MCM$$

Next, in the full color printer according to this embodiment, the printing operation of a color image is performed as follows.

In the full color printer, as shown in FIGS. 2 to 4, at the time of the printing operation, the photoconductor drum 2 is driven to rotate at a predetermined velocity (about 150 mm/sec) by the drive motor 40, while the intermediate transfer belt 6 wound on the surface of the photoconductor drum 2 is driven. In that event, during the cycle up 1, correction values PR_Vel and Lead_Reg of the driving velocity of the photoconductor drum 2 and the lead registration in image exposure of the surface of the photoconductor drum 2 as to the first color yellow are set by the control portion 45 as shown in Step 301 in FIG. 14.

Here, the correction values PR_Vel and Lead_Reg of the driving velocity of the photoconductor drum 2 and the lead registration in image exposure of the surface of the photoconductor drum 2 as to the first color yellow are set as follows.

$$PR_Vel=PR_Vel_Y1A+PR_Vel_Y1AM$$

$$Lead_Reg=Lead_Reg_Y1+Lead_Reg_Y1M$$

Of the aforementioned correction values, PR_Vel_Y1AM and Lead_Reg_Y1M are set in the manual mode separately in advance.

Figure 15:
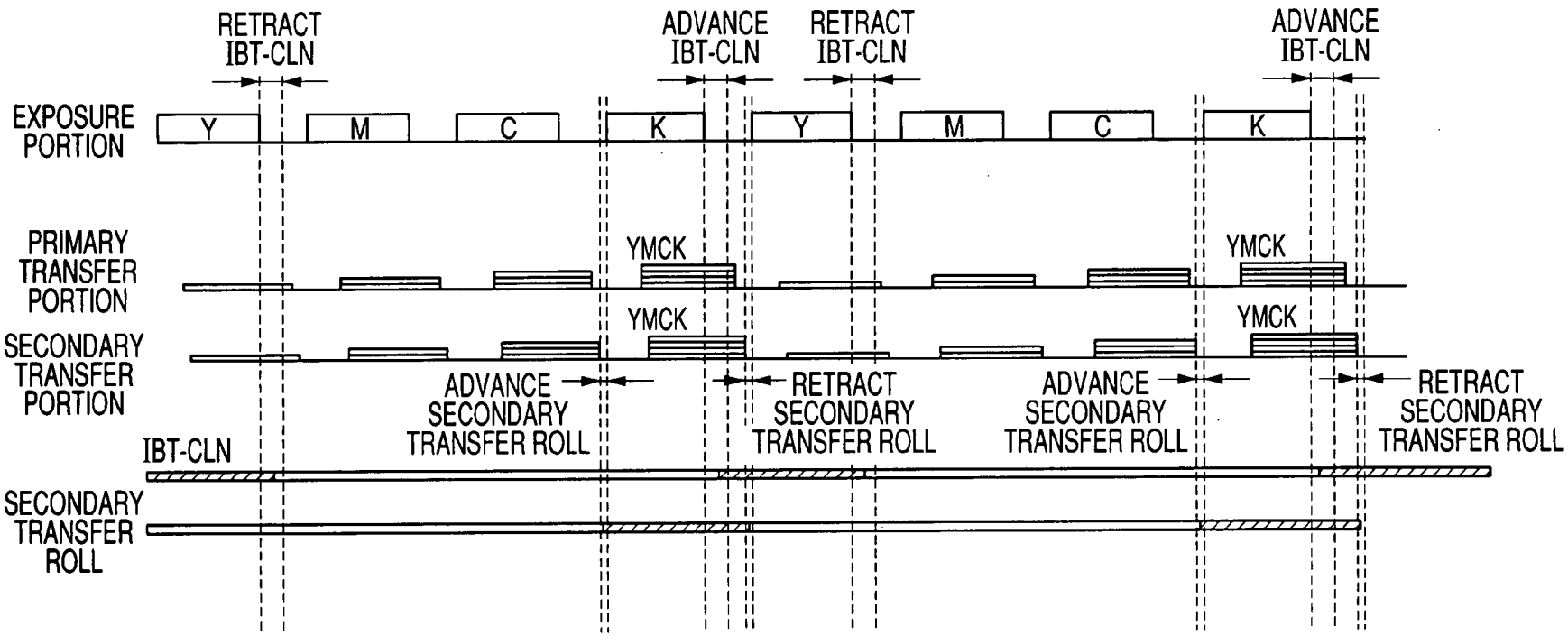
FIG. 15 is a timing chart showing the operation of the full color printer as image forming apparatus according to the first embodiment of the invention.

After that, the surface of the photoconductor drum 2 is charged to predetermined potential by the charging roll 3 as shown in FIG. 3. Then, image exposure corresponding to an image of the first color yellow is performed on the surface of the photoconductor drum 2 by the ROS 4 as shown in FIG. 15. Thus, an electrostatic latent image is formed. The electrostatic latent image formed on the photoconductor drum 2 is developed by the yellow development device 5Y of the rotary development unit 5 so that a yellow toner image is formed on the surface of the photoconductor drum 2.

In that event, as shown in FIG. 15, the cleaning unit 18 is in contact with the surface of the intermediate transfer belt 6 prior to the image exposure of the first color yellow performed on the surface of the photoconductor drum 2. Accordingly, the surface of the intermediate transfer belt 6 has been cleaned by the cleaning unit 18. That is, the image exposure of the first color yellow on the surface of the photoconductor drum 2 is performed with the cleaning unit 18 in contact with the surface of the intermediate transfer belt 6 wound on the surface of the photoconductor drum 2 and driven to rotate.

Figure 16:
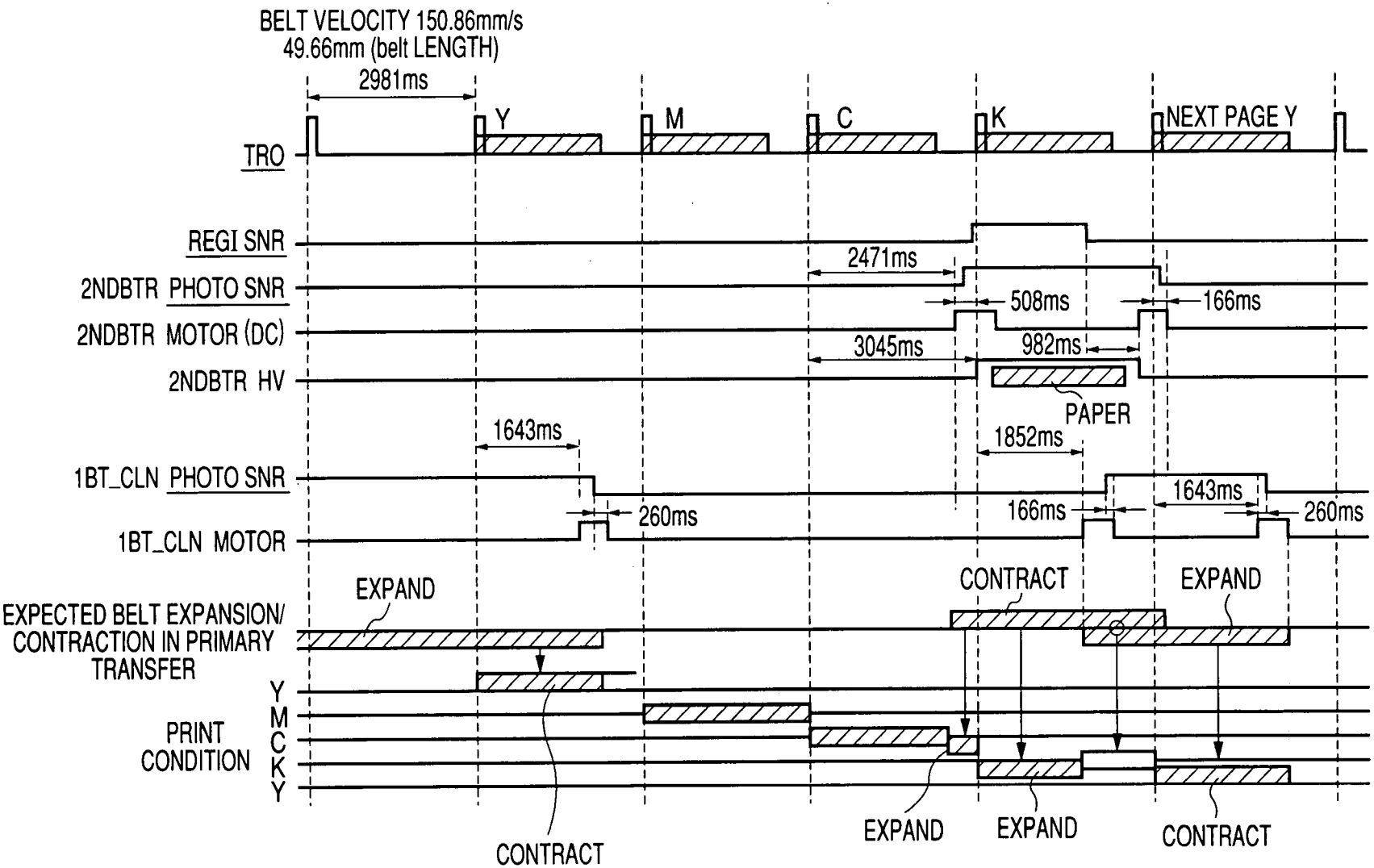
FIG. 16 is a timing chart showing the operation of the full color printer as image forming apparatus according to the first embodiment of the invention.

When the cleaning unit 18 is in contact with the surface of the intermediate transfer belt 6, a load is applied to the intermediate transfer belt 6 driven by the photoconductor drum 2 because the cleaning unit 18 is in contact with the intermediate transfer belt 6 on the upstream side with respect to the position where the intermediate transfer belt 6 is wound on the photoconductor drum 2. Since the intermediate transfer belt 6 is made of an elastic belt, the intermediate transfer belt 6 expands as shown in FIG. 16 due to the load applied to the intermediate transfer belt 6. Thus, the image exposure and development of the first color yellow are performed with the intermediate transfer belt 6 expanding. As a result, the yellow toner image is transferred onto the intermediate transfer belt 6 as shown in FIG. 16. That is, when the cleaning unit 18 leaves the intermediate transfer belt 6 after the yellow image exposure, the intermediate transfer belt 6 is contracted so that the yellow toner image transferred onto the intermediate transfer belt 6 is contracted thereon.

Figure 14:
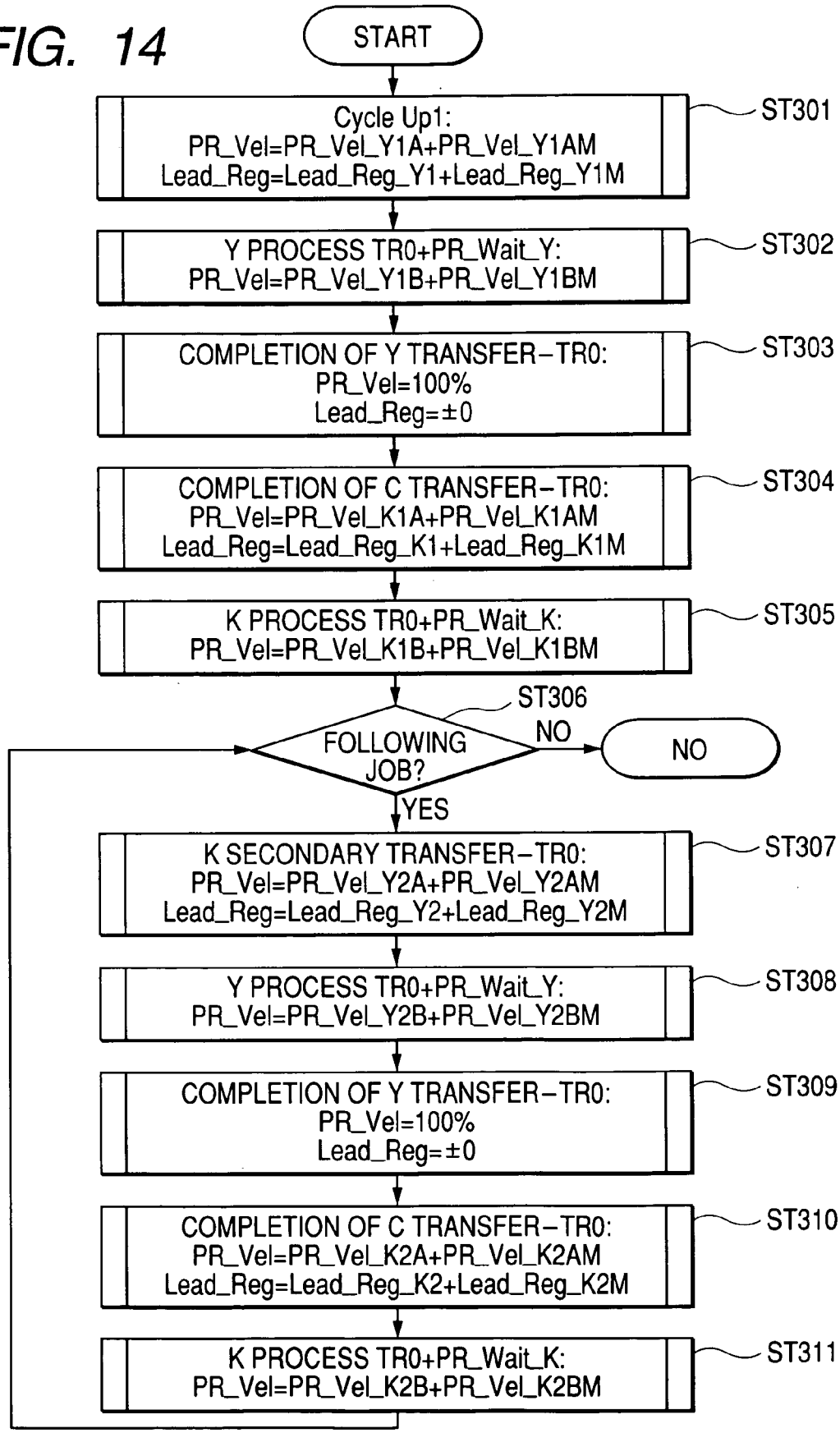
FIG. 14 is a flow chart showing the operation of the control portion of the full color printer as image forming apparatus according to the first embodiment of the invention.

Therefore, in the full color printer, as shown in FIG. 14, the image of the first color yellow is formed as follows. That is, the driving velocity of the photoconductor drum 2 and the lead registration in the image exposure on the surface of the photoconductor drum 2 are controlled in accordance with the correction values PR_Vel and Lead_Reg so that the driving velocity of the photoconductor drum 2 is made slower by a given value obtained by the measured value TR0, while the lead registration in the image exposure on the surface of the photoconductor drum 2 is made faster by a given value obtained by the measured value TR0.

Next, when the yellow image exposure on the surface of the photoconductor drum 2 is terminated, the cleaning unit 18 is separated from the surface of the intermediate transfer belt 6 as shown in FIG. 15. In this event, the yellow toner image formed on the surface of the photoconductor drum 2 has been primary-transferred onto the intermediate transfer belt 6 in the primary transfer position as shown in FIG. 15. Therefore, when the cleaning unit 18 is separated at given timing, the load on the intermediate transfer belt 6 is reduced correspondingly so that the intermediate transfer belt 6 is contracted.

Therefore, when a predetermined time PR_Wait_Y has passed since the detection of TR0, that is, at the timing when the cleaning unit 18 is separated from the intermediate transfer belt 6, the control portion 45 switches the velocity correction value of the photoconductor drum 2 for yellow to the following value again as shown in Step 302 in FIG. 14.

$$PR_Vel=PR_Vel_Y1B+PR_Vel_Y1BM$$

Incidentally, of the correction values, PR_Vel_Y1BM is set in the manual mode separately in advance.

Here, when the cleaning unit 18 leaves the surface of the intermediate transfer belt 6, no load of the cleaning unit 18 is applied onto the intermediate transfer belt 6. Thus, the intermediate transfer belt 6 is contracted to its initial state.

After that, the surface of the photoconductor drum 2 is charged to predetermined potential by the charging roll 3, and image exposure corresponding to an image of the second color magenta is performed by the ROS 4 by way of example as shown in FIG. 15. Thus, an electrostatic latent image is formed. The electrostatic latent image formed on the photoconductor drum 2 is developed by the magenta development device 5M of the rotary development unit 5 so that a magenta toner image is formed on the surface of the photoconductor drum 2. The magenta toner image formed on the surface of the photoconductor drum 2 is primary-transferred onto the intermediate transfer belt 6 in the primary transfer position so that the magenta toner image is superimposed on the yellow toner image which has been transferred onto the intermediate transfer belt 6, as shown in FIG. 15.

Incidentally, as shown in FIG. 3, the image exposure and development of magenta are performed with both the cleaning unit 18 and the secondary transfer roll 8 away from the surface of the intermediate transfer belt 6. Accordingly, as shown in Step 303 in FIG. 14, between the time when the primary transfer of the yellow toner image is completed and the time when the next TR0 is detected, the correction value PR_Vel of the driving velocity of the photoconductor drum 2 is set to be 100%, while the correction value Lead_Reg of the lead registration in the image exposure on the surface of the photoconductor drum 2 is set to be ±0.

Next, the surface of the photoconductor drum 2 is charged to predetermined potential by the charging roll 3. Then, image exposure corresponding to an image of the third color cyan is performed on the surface of the photoconductor drum 2 by the ROS 4 as shown in FIG. 15. Thus, an electrostatic latent image is formed. The electrostatic latent image formed on the photoconductor drum 2 is developed by the cyan development device 5C of the rotary development unit 5 so that a cyan toner image is formed on the surface of the photoconductor drum 2. The cyan toner image formed on the surface of the photoconductor drum 2 is primary-transferred onto the intermediate transfer belt 6 in the primary transfer position so that the cyan toner image is superimposed on the yellow and magenta toner images which have been transferred onto the intermediate transfer belt 6, as shown in FIG. 15.

Incidentally, as shown in FIG. 3, the image exposure and development of cyan are also performed with both the cleaning unit 18 and the secondary transfer roll 8 away from the surface of the intermediate transfer belt 6. Accordingly, the correction value PR_Vel of the driving velocity of the photoconductor drum 2 remains set to be 100%, while the correction value Lead_Reg of the lead registration in the image exposure on the surface of the photoconductor drum 2 remains set to be ±0.

Further, the surface of the photoconductor drum 2 is charged to predetermined potential by the charging roll 3. Then, image exposure corresponding to an image of the last color black is performed on the surface of the photoconductor drum 2 by the ROS 4 as shown in FIG. 9. Thus, an electrostatic latent image is formed. The electrostatic latent image formed on the photoconductor drum 2 is developed by the black development device 5K of the rotary development unit 5 so that a black toner image is formed on the surface of the photoconductor drum 2. The black toner image formed on the surface of the photoconductor drum 2 is primary-transferred onto the intermediate transfer belt 6 in the primary transfer position so that the black toner image is superimposed on the yellow, magenta and cyan toner images which have been transferred onto the intermediate transfer belt 6, as shown in FIG. 9.

In that event, as shown in FIG. 15, the secondary transfer roll 8 abuts against the surface of the intermediate transfer belt 6 prior to the black image exposure. The intermediate transfer belt 6 wound on the surface of the photoconductor drum 2 is driven to rotate. With the increase of the load on the intermediate transfer belt 6 due to the abutment of the secondary transfer roll 8 against the surface of the intermediate transfer belt 6, the intermediate transfer belt 6 is contracted as shown in FIG. 16. On the contrary, when the black image exposure on the photoconductor drum 2 is terminated, the cleaning unit 18 abuts against the surface of the intermediate transfer belt 6. In this event, the load on the intermediate transfer belt 6 increases due to the cleaning unit 18, while the intermediate transfer belt 6 wound on the surface of the photoconductor drum 2 is driven to rotate. As a result, it can be expected that contraction and expansion cancel each other in the black toner image primary-transferred from the photoconductor drum 2 onto the intermediate transfer belt 6.

As shown in Step 304 in FIG. 14, therefore, at the timing between the time when the primary transfer of the cyan toner image is terminated and the time when the next TR0 is detected, the control portion 45 sets the correction value PR_Vel of the driving velocity of the photoconductor drum 2 for black and the correction value Lead_Reg of the lead registration in the image exposure on the surface of the photoconductor drum 2 as follows.

$$PR_Vel = PR_Vel_K1A + PR_Vel_K1AM$$

$$Lead_Reg = Lead_Reg_K1 + Lead_Reg_K1M$$

Of the correction values, PR_Vel_K1AM and Lead_Reg_K1M are set in the manual mode separately in advance.

In such a manner, as shown in FIG. 15, the secondary transfer roll 8 is in contact with the surface of the intermediate transfer belt 6 prior to the image exposure of the last color black performed on the surface of the photoconductor drum 2. That is, the image exposure of the last color black on the surface of the photoconductor drum 2 is performed with the secondary transfer roll 8 remaining in contact with the surface of the intermediate transfer belt 6 wound on the surface of the photoconductor drum 2 and driven thereby.

In the state where the secondary transfer roll 8 is in contact with the surface of the intermediate transfer belt 6, the second transfer roll 8 abuts against the intermediate transfer belt 6, which is driven by the photoconductor drum 2, extremely closely to the position where the intermediate transfer belt 6 is wound on the photoconductor drum 2, and on the down stream side with respect to the position. Thus, the intermediate transfer belt 6 fed out is braked with respect to the rotation of the photoconductor drum 2 due to the load applied by the secondary transfer roll 8. Since the intermediate transfer belt 6 is made of an elastic belt, the intermediate transfer belt 6 is contracted as shown in FIG. 16 due to the load applied to the intermediate transfer belt 6 on the downstream side thereof. Thus, the image exposure and development of the last color black are performed with the intermediate transfer belt 6 being contracted. As a result, the black toner image formed on the photoconductor drum 2 is primary-transferred onto the intermediate transfer belt 6 which is contracted. Accordingly, as shown in FIG. 16, the black toner image is finally expanded relatively to the magenta toner image or the cyan toner image.

Therefore, in the full color printer, as shown in Step 304 in FIG. 14, the black image is formed as follows. That is, the driving velocity of the photoconductor drum 2 and the lead registration in the image exposure on the surface of the photoconductor drum 2 are controlled in accordance with the correction values PR_Vel and Lead_Reg so that the driving velocity of the photoconductor drum 2 is made faster by a given value obtained by the measured value TR0, while the lead registration in the image exposure on the surface of the photoconductor drum 2 is made slower by a given value obtained by the measured value TR0.

When the black image exposure on the surface of the photoconductor drum 2 is terminated, the cleaning unit 18 abuts against the surface of the intermediate transfer belt 6 as shown in FIG. 15. Thus, the load on the intermediate transfer belt 6 increases. Therefore, the intermediate transfer belt 6 is contracted with both the operation of contraction due to the secondary transfer roll 8 and the operation of expansion due to the cleaning unit 18 acting on the intermediate transfer belt 6 concurrently.

Therefore, when a predetermined time PR_Wait_K has passed since the detection of TR0 as to black, that is, at the timing when the cleaning unit 18 abuts against the intermediate transfer belt 6, the velocity correction value of the photoconductor drum 2 for black is switched to the following value again as shown in Step 305 in FIG. 14.

$$PR_Vel=PR_Vel_K1B+PR_Vel_K1BM$$

Incidentally, of the correction values, PR_Vel_K1BM is set in the manual mode separately in advance.

Next, as shown in Step 306 in FIG. 14, the control portion 45 judges whether there is a following job or not. When there is no following job, the image formation operation is terminated. On the contrary, when the control portion 45 concludes that there is a following job, the correction values PR_Vel and Lead_Reg of the driving velocity of the photoconductor drum 2 for yellow in the second print and the lead registration in the image exposure on the surface of the photoconductor drum 2 are set as shown in Step 307 in FIG. 14, between the time when the secondary transfer of the black toner image is completed and the time when the next TR0 is detected.

Here, the correction value PR_Vel of the driving velocity and the correction value Lead_Reg of the lead registration in the image exposure on the surface of the photoconductor drum 2 are set for yellow in the second print as follows.

$$PR_Vel=PR_Vel_Y2A+PR_Vel_Y2AM$$

$$Lead_Reg=Lead_Reg_Y2+Lead_Reg_Y2M$$

Of the correction values, PR_Vel_Y2AM and Lead_Reg_Y2M are set in the manual mode separately in advance.

After that, in the same manner as in the first print, the surface of the photoconductor drum 2 is charged to predetermined potential by the charging roll 3, and image exposure corresponding to an image of the first color yellow is performed by the ROS 4, as shown in FIG. 15. Thus, an electrostatic latent image is formed. The electrostatic latent image formed on the photoconductor drum 2 is developed by the yellow development device 5Y of the rotary development unit 5 so that a yellow toner image is formed on the surface of the photoconductor drum 2.

In that event, as shown in FIG. 15, the cleaning unit 18 is in contact with the surface of the intermediate transfer belt 6 prior to the image exposure of the first color yellow performed on the surface of the photoconductor drum 2. Accordingly, the surface of the intermediate transfer belt 6 has been cleaned by the cleaning unit 18. That is, the first yellow image exposure on the surface of the photoconductor drum 2 is performed with the cleaning unit 18 in contact with the surface of the intermediate transfer belt 6 wound on the surface of the photoconductor drum 2 and driven thereby.

Next, when the yellow image exposure on the surface of the photoconductor drum 2 is terminated, the cleaning unit 18 is separated from the surface of the intermediate transfer belt 6 as shown in FIG. 15. In this event, the yellow toner image formed on the surface of the photoconductor drum 2 has been primary-transferred onto the intermediate transfer belt 6 in the primary transfer position as shown in FIG. 15. Therefore, when the cleaning unit 18 is separated at given timing, the load on the intermediate transfer belt 6 is reduced correspondingly so that the intermediate transfer belt 6 is contracted.

Therefore, when a predetermined time PR_Wait_Y has passed since the detection of TR0, that is, at the timing when the cleaning unit 18 is separated from the intermediate transfer belt 6, the control portion 45 switches the velocity correction value of the photoconductor drum 2 for yellow to the following value again as shown in Step 308 in FIG. 14.

$$PR_Vel=PR_Vel_Y2B+PR_Vel_Y2BM$$

Incidentally, of the correction values, PR_*Vel*_*Y2BM* is set in the manual mode separately in advance.

After that, the surface of the photoconductor drum 2 is charged to predetermined potential by the charging roll 3, and image exposure corresponding to an image of the second color magenta is then performed by the ROS 4 by way of example as shown in FIG. 15. Thus, an electrostatic latent image is formed. The electrostatic latent image formed on the photoconductor drum 2 is developed by the magenta development device 5M of the rotary development unit 5 so that a magenta toner image is formed on the surface of the photoconductor drum 2. The magenta toner image formed on the surface of the photoconductor drum 2 is primary-transferred onto the intermediate transfer belt 6 in the primary transfer position so that the magenta toner image is superimposed on the yellow toner image which has been transferred onto the intermediate transfer belt 6, as shown in FIG. 15.

Incidentally, as shown in FIG. 3, the image exposure and development of magenta are performed with both the cleaning unit 18 and the secondary transfer roll 8 away from the surface of the intermediate transfer belt 6. Accordingly, as shown in Step 309 in FIG. 14, between the time when the primary transfer of the yellow toner image is completed and the time when the next TR0 is detected, the correction value PR_Vel of the driving velocity of the photoconductor drum 2 is set to be 100%, while the correction value Lead_Reg of the lead registration in the image exposure on the surface of the photoconductor drum 2 is set to be ±0.

Next, the surface of the photoconductor drum 2 is charged to predetermined potential by the charging roll 3. Then, image exposure corresponding to an image of the third color cyan is performed on the surface of the photoconductor drum 2 by the ROS 4 as shown in FIG. 15. Thus, an electrostatic latent image is formed. The electrostatic latent image formed on the photoconductor drum 2 is developed by the cyan development device 5C of the rotary development unit 5 so that a cyan toner image is formed on the surface of the photoconductor drum 2. The cyan toner image formed on the surface of the photoconductor drum 2 is primary-transferred onto the intermediate transfer belt 6 in the primary transfer position so that the cyan toner image is superimposed on the yellow and magenta toner images which have been transferred onto the intermediate transfer belt 6, as shown in FIG. 9.

Incidentally, as shown in FIG. 3, the image exposure and development of cyan are also performed with both the cleaning unit 18 and the secondary transfer roll 8 away from the surface of the intermediate transfer belt 6. Accordingly, the correction value PR_Vel of the driving velocity of the photoconductor drum 2 remains set to be 100%, while the correction value Lead_Reg of the lead registration in the image exposure on the surface of the photoconductor drum 2 remains set to be ±0.

Further, the surface of the photoconductor drum 2 is charged to predetermined potential by the charging roll 3. Then, image exposure corresponding to an image of the fourth color black is performed on the surface of the photoconductor drum 2 by the ROS 4 as shown in FIG. 15. Thus, an electrostatic latent image is formed. The electrostatic latent image formed on the photoconductor drum 2 is developed by the black development device 5K of the rotary development unit 5 so that a black toner image is formed on the surface of the photoconductor drum 2. The black toner image formed on the surface of the photoconductor drum 2 is primary-transferred onto the intermediate transfer belt 6 in the primary transfer position so that the black toner image is superimposed on the yellow, magenta and cyan toner images which have been transferred onto the intermediate transfer belt 6, as shown in FIG. 15.

In that event, as shown in FIG. 15, the secondary transfer roll 8 abuts against the surface of the intermediate transfer belt 6 prior to the black image exposure. The intermediate transfer belt 6 wound on the surface of the photoconductor drum 2 is driven to rotate. With the increase of the load on the intermediate transfer belt 6 due to the secondary transfer roll 8 abutting against the surface of the intermediate transfer belt 6, the intermediate transfer belt 6 is contracted as shown in FIG. 16. On the contrary, when the black image exposure on the photoconductor drum 2 is terminated, the cleaning unit 18 abuts against the surface of the intermediate transfer belt 6. In this event, the load on the intermediate transfer belt 6 increases due to the cleaning unit 18, while the intermediate transfer belt 6 wound on the surface of the photoconductor drum 2 is driven to rotate. As a result, it can be expected that contraction and expansion cancel each other in the black toner image primary-transferred from the photoconductor drum 2 onto the intermediate transfer belt 6.

As shown in Step 310 in FIG. 14, therefore, at the timing between the time when the primary transfer of the cyan toner image is terminated and the time when the next TR0 is detected, the control portion 45 sets the correction value PR_Vel of the driving velocity of the photoconductor drum 2 for black and the correction value Lead_Reg of the lead registration in the image exposure on the surface of the photoconductor drum 2 as follows.

$$PR_Vel = PR_Vel_K2A + PR_Vel_K2AM$$

$$Lead_Reg = Lead_Reg_K2 + Lead_Reg_K2M$$

Of the correction values, PR_*Vel*_K2AM and Lead_Reg_K2M are set in the manual mode separately in advance.

In such a manner, as shown in FIG. 15, the secondary transfer roll 8 is in contact with the surface of the intermediate transfer belt 6 prior to the image exposure of the last color black performed on the surface of the photoconductor drum 2. That is, the image exposure of the last color black on the surface of the photoconductor drum 2 is performed with the secondary transfer roll 8 remaining in contact with the surface of the intermediate transfer belt 6 wound on the surface of the photoconductor drum 2 and driven thereby.

When the black image exposure on the surface of the photoconductor drum 2 is terminated, the cleaning unit 18 abuts against the surface of the intermediate transfer belt 6 as shown in FIG. 15. Thus, the load on the intermediate transfer belt 6 increases. Therefore, the intermediate transfer belt 6 is contracted with both the operation of contraction due to the secondary transfer roll 8 and the operation of expansion due to the cleaning unit 18 acting on the intermediate transfer belt 6 concurrently.

Therefore, when a predetermined time PR_Wait_K has passed since the detection of TR0 as to black, that is, at the timing when the cleaning unit 18 abuts against the intermediate transfer belt 6, the control portion 45 switches the velocity correction value of the photoconductor drum 2 for black to the following value again as shown in Step 311 in FIG. 14.

$$PR_Vel = PR_Vel_K2B + PR_Vel_K2BM$$

Incidentally, of the correction values, PR_Vel_K2BM is set in the manual mode separately in advance.

In such a manner, according to the aforementioned embodiment, the load on the intermediate transfer belt 6 fluctuates due to the cleaning unit 18 or the secondary transfer roll 8 abutting against or separating from the intermediate transfer belt 6 in the image formation process in which each of toner images of colors of yellow (Y), magenta (M), cyan (C) and black (K) is formed on the photoconductor drum 2, when each of the toner images of the colors of yellow (Y), magenta (M), cyan (C) and black (K) formed on the photoconductor drum 2 is primary-transferred onto the intermediate transfer belt 6, or when toner images of plural colors are secondary-transferred from the intermediate transfer belt 6 onto recording paper in a lump.

Figure 17A:
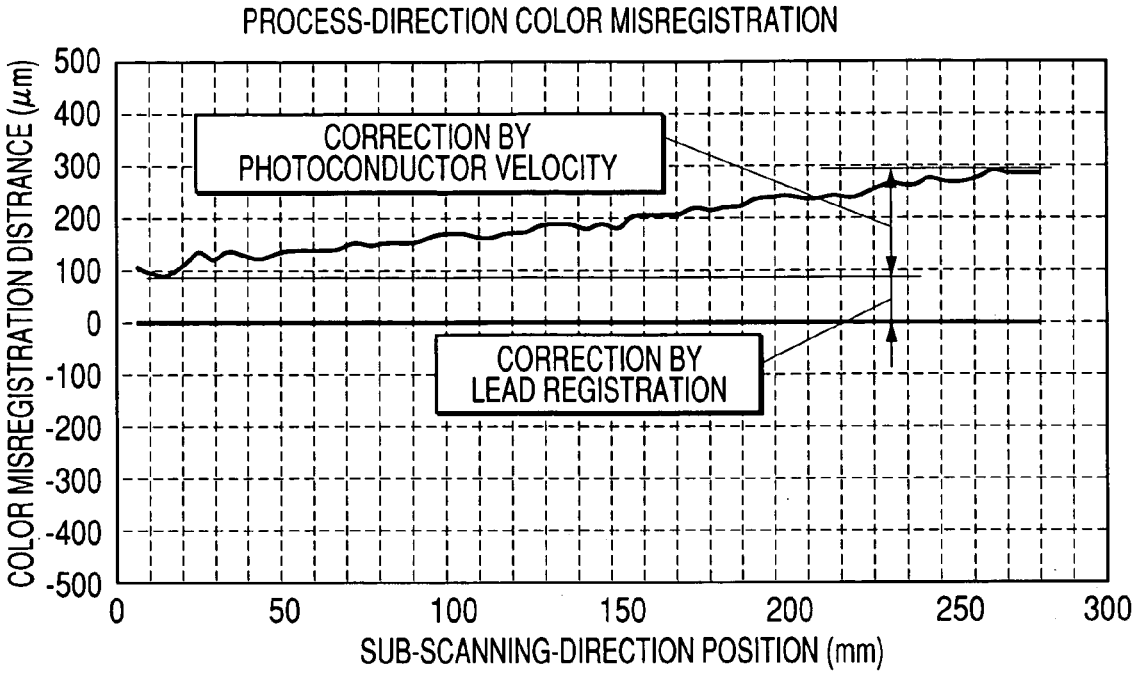
FIGS. 17A to 17C are graphs showing the operation of the full color printer as image forming apparatus according to the first embodiment of the invention.

Accordingly, in the full color printer, if no correction control is performed, the toner images of yellow (Y), magenta (M) and black (K) will be misregistered with reference to the toner image of cyan (C) due to the expansion/contraction of the intermediate transfer belt 6 caused by the fluctuation of the load on the intermediate transfer belt 6 as shown in FIG. 17A. The misregistration will increase as the position approaches the rear end of the recording paper.

Therefore, in the full color printer according to this embodiment, as shown in FIG. 6, a pair of color misregistration detection pattern images 51 and 52 are formed on the recording paper 9 so that the operator observes the pair of the color misregistration direction pattern images 51 and 52 visually to thereby obtain the distance of color registration of a color to be detected with respect to the reference color in three portions, that is, the lead portion, the center portion and the tail portion of the recording paper 9. The obtained distance of color registration is inputted through an operation panel.

Figure 17B:
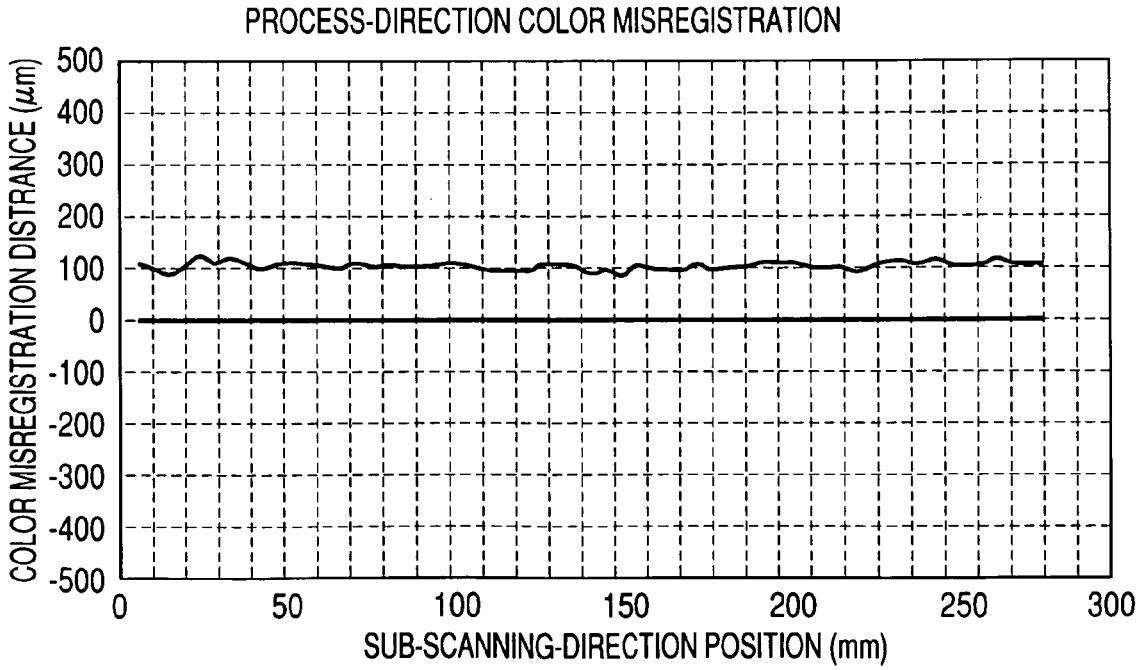

In the full color printer, as shown in FIG. 14, the driving velocity of the photoconductor drum 2 is controlled at predetermined timing so that the image misregistration due to the fluctuation of the load on the intermediate transfer belt 6 is corrected. Thus, the distance of misregistration in each of the toner images of yellow (Y), magenta (M) and black (K) can be made substantially uniform all over the length of the recording paper with reference to the toner image of cyan as shown in FIG. 17B.

Figure 17C:
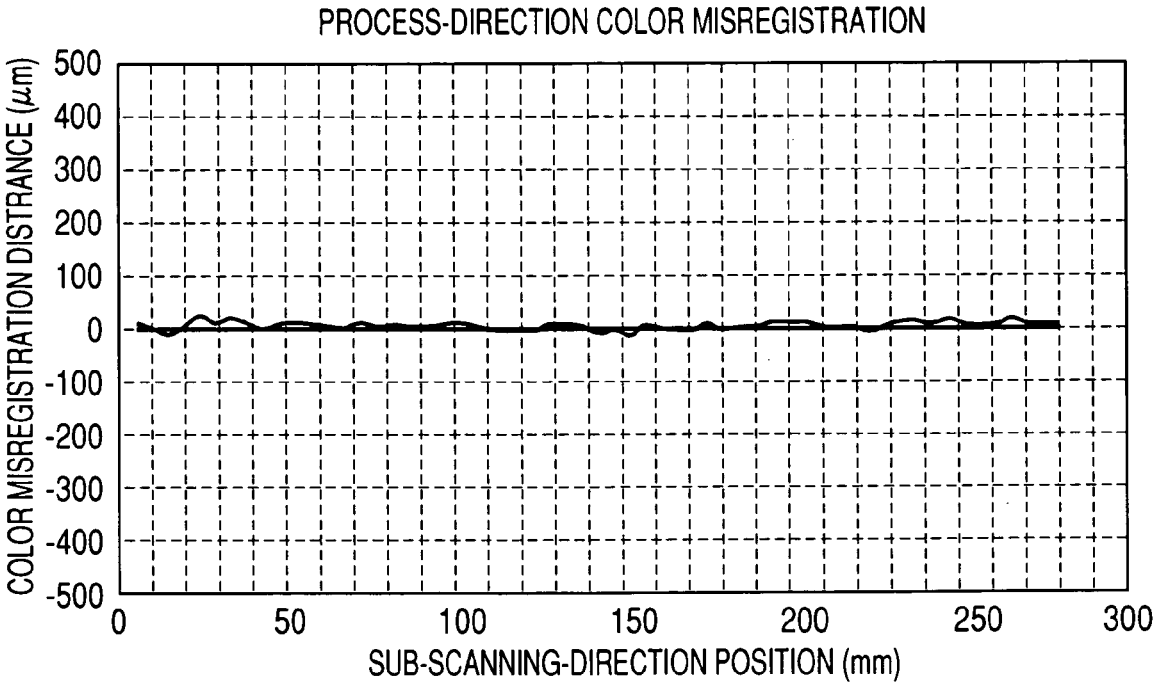

As a result, in the full color printer, the distance of lead misregistration with respect to the photoconductor drum 2 is corrected together as shown in FIG. 14, so that the distance of misregistration in each of the toner images of yellow (Y), magenta (M) and black (K) with reference to the cyan toner image can be reduced on a large scale all over the length of the recording paper as shown in FIG. 17C. Thus, a high-quality color image can be formed.

Accordingly, in the full color printer, even when the operation of the cleaning unit 18 or the secondary transfer roll 8 touching/leaving the surface of the intermediate transfer belt 6 is inserted into the image formation operation, color misregistration can be prevented from occurring, and a high-quality image can be formed without lowering the productivity.

Incidentally, in the aforementioned embodiment, the operation of correcting the driving velocity of the photoconductor drum 2 and the lead registration is executed not only in the manual mode but also in the automatic mode. Not to say, however, it may be designed that the operation of correcting the driving velocity of the photoconductor drum 2 and the lead registration is executed only in the manual mode.

[Second Embodiment]

Figure 18:
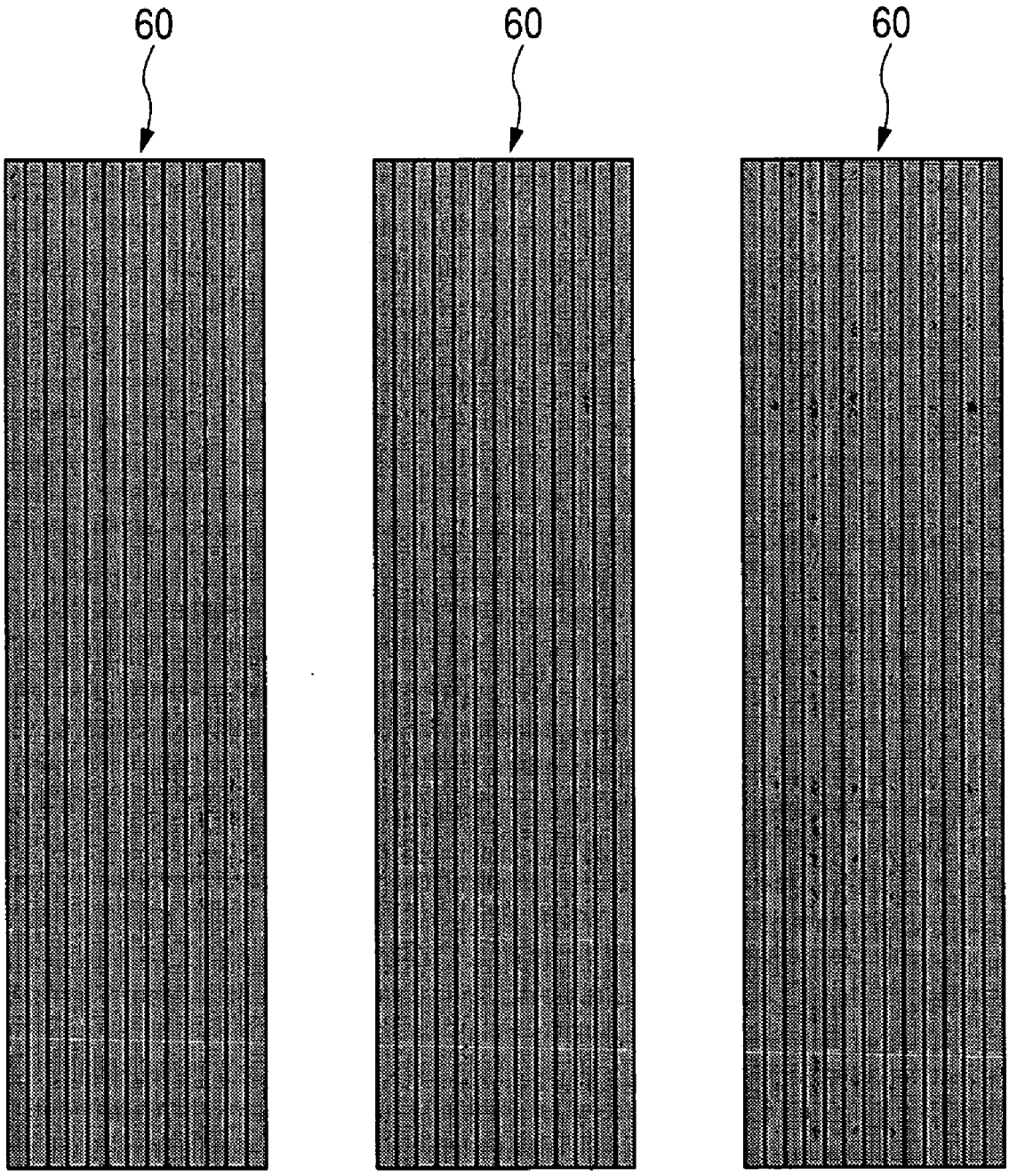
FIG. 18 is a configuration view showing color misregistration detection toner images to be used in a full color printer as image forming apparatus according to a second embodiment of the invention.

FIG. 18 shows a second embodiment of the invention. Parts the same as those in the first embodiment are denoted by the same reference numerals correspondingly. The second embodiment is adapted so that the second interval is equivalent to the first interval, and the second toner image group is superimposed on the first toner image group to form a first pattern image. The second interval is equivalent to the first interval, and the second toner image group is superimposed on the first toner image group with shifting the second toner image group by ±1 pixel respectively in the rotating direction of the image carrier to form second pattern images on both lateral sides of the first pattern image. The second interval is equivalent to the first interval, and the second toner image group is superimposed on the first toner image group with shifting the second toner image group by ±N pixels (N is an integer greater than or equal to 2) respectively in the rotating direction of the image carrier to form N+1-th pattern images next to Nth pattern images.

Figure 19:
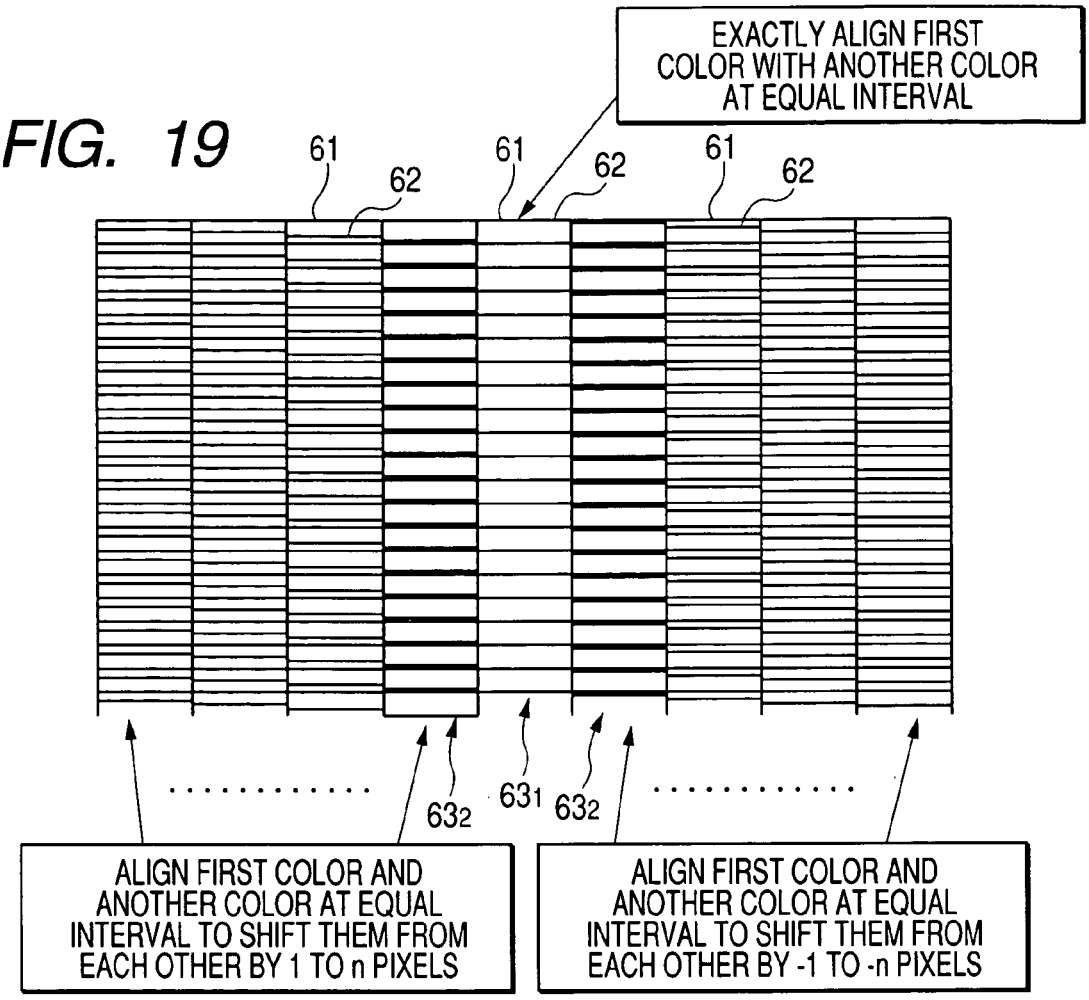
FIG. 19 is a configuration view showing the color misregistration detection toner images to be used in the full color printer as image forming apparatus according to the second embodiment of the invention.

That is, in the second embodiment, as shown in FIGS. 18 and 19, a pair of color misregistration detection pattern images 60 are made of a series of pattern images arranged by disposing first pattern images $\mathbf{63}_1$, second pattern images $\mathbf{63}_2$, . . . , (N+1)th pattern images $\mathbf{63}_{N+1}$ in turn adjacently to one another. The first pattern images 63, include a toner image 61 for detecting color misregistration of one color and a toner image 62 for detecting color misregistration of another color. The toner image 61 for detecting color misregistration of one color is formed at a predetermined interval in the rotating direction of the belt-like image carrier 6. The toner image 62 for detecting color misregistration of another color is formed at an interval equal to the predetermined interval and superimposed on the toner image 61 for detecting color misregistration of one color. The second pattern images $\mathbf{63}_2$ are formed by superimposing toner images each having an interval equal to the predetermined interval. The toner images are obtained by shifting the toner image 61 for detecting color misregistration of one color and the toner image 62 for detecting color misregistration of another color by ±1 pixel respectively in the rotating direction of the image carrier. The second pattern images $\mathbf{63}_2$ are disposed on opposite, left and right sides of the first pattern images $\mathbf{63}_1$ so as to be adjacent thereto respectively. In the same manner, the third to (N+1)th pattern images $\mathbf{63}_3$, $\mathbf{63}_4$, . . . and $\mathbf{63}_{N+1}$ are obtained by superimposing toner images likewise. The toner images are obtained by shifting the toner image 61 for detecting color misregistration of one color and the toner image 62 for detecting color misregistration of another color by ±2, ±3, . . . , ±N pixels respectively in the same manner. The third to (N+1)th pattern images $\mathbf{63}_3$ to $\mathbf{63}_{N+1}$ are disposed in turn adjacently to one another.

In the second embodiment, as shown in FIGS. 18 and 19, the occurrence of any color misregistration on the recording paper 9 can be detected continuously in the rotating direction of the intermediate transfer belt 6. Thus, detection or correction of color misregistration can be controlled with higher accuracy.

The other configuration and operation are similar to those in the first embodiment, and description thereof will be omitted.

The invention provides the image forming apparatus including a control portion that corrects a color misregistration distance detected based on the pattern images.

The invention provides the image forming apparatus, in which the pattern image forming unit forms the pattern image in which the second interval is different from the first interval, and the second toner image group is superimposed on the first toner image group at same position.

According to this configuration, the toner image for detecting color misregistration of one color and the toner image for detecting color misregistration of another color are formed to be superimposed on each other. Thus, even in a combination such as yellow and magenta, which are different to distinguish in the pattern images according to the first configuration, color misregistration can be confirmed visually easily with reference to the center (centroid) of a thick colored portion.

The invention provides the image forming apparatus, in which the pattern image forming unit forms a first pattern image in which the second interval is equivalent to the first interval, and the second toner image group is superimposed on the first toner image group, forms second pattern images in which the second interval is equivalent to the first interval, and the second toner image group is superimposed on the first toner image group with shifting the second toner image group by ±1 pixel respectively in the rotating direction of the image carrier on both lateral sides of the first pattern image, and forms N+1-th pattern images in which the second interval is equivalent to the first interval, and the second toner image group is superimposed on the first toner image group with shifting the second toner image group by ±N pixels (N is an integer greater than or equal to 2) respectively in the rotating direction of the image carrier next to Nth pattern images.

According to this configuration, the first pattern images to the (N+1)th pattern images are looked over as one set. When the Nth pattern image looks the most thin, the color registration distance is determined to be n−1 pixels. Determination is easy and accurate, and any combination of two colors can be used. In addition, the misregistration distance can be confirmed all over the paper length.

The invention provides the image forming apparatus, in which each toner image group included in the pattern images is formed by identifiable signs with which misregistration-distance is enabled to be identified.

The invention provides the image forming apparatus, in which the identifiable signs are numeric or alphabetic characters.

According to these configurations, the color misregistration distance confirmed on the pattern images is inputted into the apparatus as a correction value. Thus, the misregistration distance can be corrected easily.

The invention provides the image forming apparatus, in which a group of the pattern images is repeatedly formed plural times at a predetermined interval in the rotating direction of the image carrier.

According to this configuration, color misregistration in plural combinations of colors can be confirmed on a sheet of paper. For example, the combination of yellow and magenta and the combination of cyan and black can be confirmed on a sheet of paper.

The invention provides the image forming apparatus, in which a load is made to touch and leave to and from the image carrier at predetermined timing, while the pattern images are repeatedly formed plural times at an interval corresponding to the touching/leaving timing of the load in the rotating direction of the image carrier.

According to this configuration, the color misregistration distance increases synchronizing with the contact/separation timing of the load. It is therefore possible to perform correction effectively on a portion having large misregistration all over the paper length.

Particularly when an elastic belt having elasticity in the rotating direction of the image carrier is used as the belt-like image carrier, the image carrier is apt to expand/contract conspicuously before and after the contact/separation of the load. When the pattern images are formed in the rotating direction of the image carrier corresponding to the vicinities of the contact and the separation, correction can be performed effectively in accordance with the contact and the separation.

The invention provides the image forming apparatus, in which the toner image of the first color is magenta, and the toner image of the second color is yellow.

According to this configuration, when a yellow image is apt to be misregistered at the contact/separation timing of the load, color misregistration is judged using a combination of yellow and cyan or yellow and magenta. When using the second configuration, the combination of yellow and cyan looks green as a whole so that judgment is difficult. Therefore, using the combination of yellow and magenta, color misregistration can be judged easily.

The invention provides the image forming apparatus, in which the toner image of the first color is one of yellow and black, and the toner image of the second color is one of cyan and magenta.

According to this configuration, when a black image is apt to be misregistered due to contact/separation of the second transfer roll for transferring the image onto paper, a combination of black and cyan or black and magenta is used so that color misregistration can be judged easily and accurately. A yellow image is apt to be misregistered in itself as described above. Using a combination of yellow and cyan or magenta, color misregistration can be judged easily and accurately.

The entire disclosure of Japanese Patent Application No. 2003-435684 filed on Dec. 26, 2003 including specification, claims, drawings and abstract is incorporated herein by reference in its entirely.

What is claimed is:

1. An image forming apparatus including an image carrier, shaped like a belt, that holds toner images of a plurality of colors, and a transfer portion that transfers the toner images of a plurality of colors held on the image carrier onto a recording medium, wherein the image carrier is made of an elastic material, comprising:

a pattern image forming unit that repeatedly forms a pattern image for color misregistration detection on the image carrier at a constant interval so as to set the pattern images within a length range of the recording medium in the rotating direction of the image carrier, wherein one of the pattern images includes a first toner image group in which a plurality of toner images of a first color is formed at a first interval in the rotating direction of the image carrier, and a second toner image group in which a plurality of toner images of a second color is formed at a second interval in the rotating direction of the image carrier.

2. The image forming apparatus according to claim 1, further comprising:

a control portion that corrects a color misregistration distance detected based on the pattern images.

3. The image forming apparatus according to claim 1, wherein the pattern image forming unit forms the pattern image in which the second interval is different from the first interval, and the second toner image group is closed to the first toner image group.

4. The image forming apparatus according to claim 1, wherein the pattern image forming unit forms the pattern image in which the second interval is different from the first interval, and the second toner image group is superimposed on the first toner image group at same position.

5. The image forming apparatus according to claim 1, wherein the pattern image forming unit forms a first pattern image in which the second interval is equivalent to the first interval, and the second toner image group is superimposed on the first toner image group, forms second pattern images in which the second interval is equivalent to the first interval, and the second toner image group is superimposed on the first toner image group with shifting the second toner image group by ±1 pixel respectively in the rotating direction of the image carrier on both lateral sides of the first pattern image, and forms N+1-th pattern images in which the second interval is equivalent to the first interval, and the second toner image group is superimposed on the first toner image group with shifting the second toner image group by ±N pixels (N is an integer greater than or equal to 2) respectively in the rotating direction of the image carrier next to Nth pattern images.

6. The image forming apparatus according to claim 1, wherein each toner image group included in the pattern images is formed by identifiable signs with which misregistration-distance is enabled to be identified.

7. The image forming apparatus according to claim 6, wherein the identifiable signs are numeric or alphabetic characters.

8. The image forming apparatus according to claim 1, wherein a group of the pattern images is repeatedly formed a plurality of times at a predetermined interval in the rotating direction of the image carrier.

9. The image forming apparatus according to claim 1, wherein a load is made to touch and leave to and from the image carrier at predetermined timing, while the pattern images are repeatedly formed a plurality of times at an interval corresponding to the touching/leaving timing of the load in the rotating direction of the image carrier.

10. The image forming apparatus according to claim 1, wherein the toner image of the first color is magenta, and the toner image of the second color is yellow.

11. The image forming apparatus according to any one of claims 1 to 4, wherein the toner image of the first color is one of yellow and black, and the toner image of the second color is one of cyan and magenta.

* * * * *